US005294747A

United States Patent [19]

Bruti et al.

[11] Patent Number: 5,294,747

[45] Date of Patent: Mar. 15, 1994

[54] AUTOMATIC CHORD GENERATING DEVICE FOR AN ELECTRONIC MUSICAL INSTRUMENT

[75] Inventors: Luigi Bruti, Pedaso; Demetrio Cuccu, Fermo, both of Italy

[73] Assignee: Roland Europe S.p.A., Teramo, Italy

[21] Appl. No.: 843,718

[22] Filed: Feb. 28, 1992

[30] Foreign Application Priority Data

Mar. 1, 1991 [IT] Italy ..... MI91 A 000539

[51] Int. Cl.[5] ..... G10H 1/38

[52] U.S. Cl. ..... 84/669; 84/DIG. 22

[58] Field of Search ..... 84/613, 637, 650–652, 84/669, 715, DIG. 22

[56] References Cited

U.S. PATENT DOCUMENTS 4,248,118 2/1981 Hall et al. .
4,315,451 2/1982 Uchiyama et al. ..... 84/DIG. 22
4,433,601 2/1984 Hall et al. .
4,864,907 9/1989 Oguri ..... 84/637

*Primary Examiner*—Stanley J. Witkowski
*Attorney, Agent, or Firm*—Keck, Mahin & Cate

[57] ABSTRACT

An automatic accompaniment device for generating chords in an electronic musical instrument. This device has a chord type information generator which indicates one of the type of chords being produced; a chord root information generator which indicates the pitch name of a root note of the chord type; and a chord bass information generator which indicates the pitch name of the lowest note of the chord type. The information from the three generators is used by an accompaniment pattern information generator to generate pattern information relating to the chord type, chord root and chord bass information. For each tone of the pattern, the pattern information contains the pitch name of a note in the chord and non chord tone of a note not present in the chord. An accompaniment pattern is generated with the accompaniment pattern information to change the pitch name of each chord tone in relation to the bass chord.

3 Claims, 25 Drawing Sheets

Pitch name of chord root: C Chord type: M

| | Key-ON pattern (KP) | Chord type (CS) | Chord name | Chord form | Inversion | Pitch name of Chord Root (RS) | Pitch name of Chord Bass (LS) | Pitch difference (DS) | Shift amount (ES) | Standard accompaniment pattern (SAS) / Accompaniment pattern (AS) | Major pitch alteration table (TB-M) |
|---|---|---|---|---|---|---|---|---|---|---|---|
| 1 | C3-E3-G3 | M | $C_M$ | Basic | 0 | C | C | 0 | | C2 D2 E2 C2' D2 E2' | C2(=0)~ →C2(=0)<br>~Not altered |
| 2 | | | | | | | | | | | |
| 3 | D3-E3-G3-C4 | M | $C_M$ (CaddS) | Special | | C | D | 2 | | D2 D2 D2 D2' D2 D2' | C2(=0)~(Except D2)→D2(=0) |
| 4 | | | | | | | | | | | |
| 5 | E3-G3-C4 | M | $C_M$ | 1st Inversion | 1 | C | E | 4 | | E2 D2 G2 E2' D2 G2' | C2(=0)→E2(=4)<br>E2(=4)→G2(=7)<br>G2(=7)→C3(=12)<br>C2(=0)~(Except C2,E2,G2)<br>→C2(=0)~Not altered |

FIG. 2A

Pitch name of chord root: C Chord type: M

| | Key-ON pattern (KP) | Chord type (CS) | Chord name | Chord form | Inversion | Pitch name of Chord Root (RS) | Pitch name of Chord Bass (LS) | Pitch difference (DS) | Shift amount (ES) | Standard accompaniment pattern (SAS) / Accompaniment pattern (AS) | Major pitch alteration table (TB-M) |
|---|---|---|---|---|---|---|---|---|---|---|---|
| 5 | | | | | | | | | | C2 D2 E2 C2' D2 E2' | |
| 6 | | | | | | | | | | | |
| 7 | | | | | | | | | | | |
| 8 | G3-C4-E4 | M | $C_M$ | 2nd Inversion | 2 | C | G | 7 | | G2 D2 C3 G2' D2 C3' | C2(=0)→G2(=7)<br>E2(=4)→C3(=12)<br>G2(=7)→E3(=16)<br>C2(=0)~(Except C2,E2,G2)<br>→C2(=0)~Not altered |

FIG. 2B

Pitch name of chord root : C  Chord type : m

| | Key-ON pattern (KP) | Chord type (CS) | Chord name | Chord form | Inversion | Pitch name of Chord Root (RS) | Pitch name of Chord Bass (LS) | Pitch difference (DS) | Shift amount (ES) | Standard accompaniment pattern (SAS) / Accompaniment pattern (AS) | Minor pitch alteration table (TB-m) |
|---|---|---|---|---|---|---|---|---|---|---|---|
| 1 | C3-E3$^b$-G3 | m | Cm | Basic | 0 | C | C | 0 | | C2 D2 E2 C2' D2 E2' / C2 D2 E2$^b$ C2' D2 E2$^{b'}$ | E2(=4)→E2$^b$(=D2#)(=3)<br>C2(=0)~(Except E2)<br>→C2(=0)~Not altered |
| 2 | | | | | | | | | | | |
| 3 | D3-E3$^b$-G3-C4 | m | Cm | Special | | C | D | 2 | | D2 D2 D2 D2' D2 D2' | C2(=0)~(Except D2)→D2(=2) |
| 4 | E3$^b$-G3-C4 | m | Cm | 1st Inversion | 1 | C | E$^b$ | 3 | | E2$^b$ D2 G2 E2$^{b'}$ D2 G2' | C2(=0)→E2$^b$(=D2#)(=3)<br>E2(=4)→G2(=7)<br>G2(=7)→C3(=12)<br>C2(=0)~(Except C2,E2,G2)<br>→C2(=0)~Not altered |

FIG. 3A

Pitch name of chord root: C Chord type: m

| | | | | | | | | | | |
|---|---|---|---|---|---|---|---|---|---|---|
| 5 | Key-ON pattern (KP) | Chord type (CS) | Chord name | Chord form | Inversion | Pitch name of Chord Root (RS) | Pitch name of Chord Bass (LS) | Pitch difference (DS) | Shift amount (ES) | Standard accompaniment pattern (SAS) / Accompaniment pattern (AS) / Major pitch alteration table (TB-M) |
| 6 | | | | | | | | | | |
| 7 | | | | | | | | | | |
| 8 | G3 – C4 – E4b | m | Cm | 2nd Inversion | 2 | C | G | 7 | | C2 D2 E2 C2' D2 E2' / G2 D2 C3 G2' D2 C3' / C2(=0) → G2(=7), E2(=4) → C3(=12), G2(=7) → E3b (=D3#)(=15), C2(=0) ~ (Except C2, E2, G2) → C2(=0) ~ Not altered |

FIG. 3 B

Pitch name of chord root: C Chord type: dim

| | Key-ON pattern (KP) | Chord type (CS) | Chord name | Chord form | Inversion | Pitch name of Chord Root (RS) | Pitch name of Chord Bass (LS) | Pitch difference (DS) | Shift amount (ES) | Standard accompaniment pattern (SAS) / Accompaniment pattern (AS) | Major pitch alteration table (TB-M) |
|---|---|---|---|---|---|---|---|---|---|---|---|
| 1 | C3-E3$^b$-G3$^b$-A3 | dim | Cdim | Basic | 0 | C | C | 0 | | C2 D2 E2 C2' D2 E2'<br>C2 D2 E2$^b$ C2' D2 E2$^b$' | E2(=4)→E2$^b$(=D2#)(=3)<br>G2(=7)→G2$^b$(=F2#)(=6)<br>C2(=0)~(Except E2, G2)<br>→C2(=0)~Not altered |
| 2 | | | | | | | | | | | |
| 3 | | | | | | | | | | | |
| 4 | E3$^b$-G3$^b$-A3-C4 | dim | Cdim | Basic* | | C (E$^b$) | E$^b$ | 3 | | E2$^b$ F2 G2$^b$ E2$^b$' F2 G2$^b$' | E2(=4)→G2$^b$(=F2#)(=6)<br>G2(=7)→A2(=9)<br>C2(=0)~(Except E2, G2)<br>→E2$^b$(=D2#)(=3)<br>~Not altered |

Used E$^b$ as the pitch name of root note

FIG. 4A

Pitch name of chord root: C Chord type: dim

| 5 | Key-ON pattern (KP) | Chord type (CS) | Chord name | Chord form | Inversion | Pitch name of Chord Root (RS) | Pitch name of Chord Bass (LS) | Pitch difference (DS) | Shift amount (ES) | Standard accompaniment pattern (SAS) / Accompaniment pattern (AS) | Major pitch alteration table (TB-M) |
|---|---|---|---|---|---|---|---|---|---|---|---|
| 6 | | | | | | | | | | | |
| 7 | $G3^b$-A3-C4-$E4^b$ | dim | Cdim | Basic* | | C ($G^b$) | $G^b$ | 6 | | $G2^b$ $A2^b$ A2 $G2^{b'}$ $A2^b$ A2' | E2(=4) → A2 (=9)<br>G2(=7) → C3 (=12)<br>C2(=0) ~ (Except E2, G2)<br>→ $G2^b$ (=F2#)(=6)<br>~ Not altered |
| 8 | | | | | | | | | | | |
| 9 | | | | | | | | | | | |
| 10 | A3-C4-$E4^b$-$G4^b$ | dim | C dim | Basic** | | C (A) | A | 9 | | A2 B2 C3 A2' B2 C3' | E2(=4) → C3 (=12)<br>G2(=7) → $E3^b$(=D3#)(=15)<br>C2(=0) ~ (Except E2, G2)<br>→ A2(=9) ~ Not altered |

Used $E^b$ as the pitch name of root note
*Used A as the pitch name of root note

FIG. 4 B

Pitch name of chord root: C Chord type: m7

| | Key-ON pattern (KP) | Chord type (CS) | Chord name | Chord form | Inversion | Pitch name of Chord Root (RS) | Pitch name of Chord Bass (LS) | Pitch difference (DS) | Shift amount (ES) | Standard accompaniment pattern (SAS) / Accompaniment pattern (AS) | Major pitch alteration table (TB-M) |
|---|---|---|---|---|---|---|---|---|---|---|---|
| 1 | C3-E3$^{b}$-G3-B3$^{b}$ | m7 | Cm7 | Basic | 0 | C | C | 0 | | C2 D2 E2 C2' D2 E2' / C2 D2 E2$^{b}$ C2' D2 E2$^{b}$' | E2(=4)→E2$^{b}$(=D2#)(=3)<br>B2(=11)→B2$^{b}$(=A2#)(=10)<br>C2(=0)～(Except E2,B2)<br>→C2(=0)～Not altered |
| 2 | | | | | | | | | | | |
| 3 | D3-E3$^{b}$-G3-B3$^{b}$-C4 | m7 | Cm7 | Special | | C | D | 2 | | D2 D2 D2 D2' D2 D2' | C2(=0)～→D2(=2)<br>(Except D2) |
| 4 | E3$^{b}$-G3-B3$^{b}$-C4 | m7 | Cm7 | 1st Inversion Basic * | 1 | C (E$^{b}$) | E$^{b}$ | 3 | | E2$^{b}$ F2 G2 E2$^{b}$' F2 G2' | C2(=0)～→E2$^{b}$(=D2#)(=3)～ |

* Used E$^{b}$ as the pitch name of root note

FIG. 5A

Pitch name of chord root: C Chord type: m

| 5 | Key-ON pattern (KP) | Chord type (CS) | Chord name | Chord form | Inversion | Pitch name of Chord Root (RS) | Pitch name of Chord Bass (LS) | Pitch difference (DS) | Shift amount (ES) | Standard accompaniment pattern (SAS) / Accompaniment pattern (AS) | Major pitch alteration table (TB-M) |
|---|---|---|---|---|---|---|---|---|---|---|---|
| 6 | | | | | | | | | | | |
| 7 | | | | | | | | | | | |
| 8 | G3-B3$^b$-C4-E4$^b$ | m7 | Cm7 | 2nd Inversion | 2 | C | G | 7 | | C2 D2 E2 C2' D2 E2' / G2 D2 B2$^b$ G2' D2 B2$^b$' | C2(=0)→G2(=7)<br>E2(=4)→B2$^b$(=A2$^\#$)(=10)<br>G2(=7)→C3(=12)<br>B2(=11)→E3$^b$(=D3$^\#$)(=15)<br>C2(=0)～(Except C2,E2,G2,B2)<br>→C2(=0)～Not altered |
| 9 | | | | | | | | | | | |
| 10 | | | | | | | | | | | |
| 11 | B3$^b$-C4-E4$^b$-G4 | m7 | Cm7 | 3rd Inversion | 3 | C | B$^b$ | 10 | | B2$^b$ D2 C3 B2$^b$' D2 C3' | C2(=0)→B2$^b$(=A2$^\#$)(=10)<br>E2(=4)→C3(=12)<br>G2(=7)→E3$^b$(=D3$^\#$)(=15)<br>B2(=11)→G3(=19)<br>C2(=0)～(Except C2,E2,G2,B2)<br>→C2(=0)～Not altered |
| 12 | | | | | | | | | | | |

FIG. 5 B

| Pitch | |
|---|---|
| Decimal number | Pitch name |
| 0 | C2 |
| 1 | C2#(=D2b) |
| 2 | D2 |
| 3 | D2#(=E2b) |
| 4 | E2 |
| 5 | F2 |
| 6 | F2#(=G2b) |
| 7 | G2 |
| 8 | G2#(=A2b) |
| 9 | A2 |
| 10 | A2#(=B2b) |
| 11 | B2 |

| Pitch | |
|---|---|
| Decimal number | Pitch name |
| 12 | C3 |
| 13 | C3#(=D3b) |
| 14 | D3 |
| 15 | D3#(=E3b) |
| 16 | E3 |
| 17 | F3 |
| 18 | F3#(=G3b) |
| 19 | G3 |
| 20 | G3#(=A3b) |
| 21 | A3 |
| 22 | A3#(=B3b) |
| 23 | B3 |

FIG. 6

Standard Accompaniment Inf. (SAS)

| | Tone inf. AS | Date | Clock data | Pitch data | ON/OFF data |
|---|---|---|---|---|---|
| 1 | C2 note inf. AS-C2 | Tone gen. data | 0 | C2 (=0) | ON |
| | | Tone stopping data | 48 | C2 (=0) | OFF |
| 2 | D2 note inf. AS-D2 | Tone gen. data | 50 | D2 (=2) | ON |
| | | Tone stopping data | 98 | D2 (=2) | OFF |
| 3 | E2 note inf. AS-E2 | Tone gen. data | 100 | E2 (=4) | ON |
| | | Tone stopping data | 148 | E2 (=4) | OFF |
| 4 | C2 note inf. AS-C2' | Tone gen. data | 150 | C2 (=0) | ON |
| | | Tone stopping data | 248 | C2 (=0) | OFF |
| 5 | D2 note inf. AS-D2 | Tone gen. data | 250 | D2 (=2) | ON |
| | | Tone stopping data | 298 | D2 (=2) | OFF |
| 6 | E2 note inf. AS-E2' | Tone gen. data | 300 | E2 (=4) | ON |
| | | Tone stopping data | 398 | E2 (=4) | OFF |

FIG. 10

Accompaniment pattern inf. as in the case of the key-ON pattern shown in Fig. 2A, column 1.
Pitch name of root note: C Shift amount: 0
Chord type: M Pitch difference: 0

| | Tone inf. AS | Date | Clock data | Pitch data | ON/OFF data |
|---|---|---|---|---|---|
| 1 | C2 note inf. AS-C2 | Tone gen. data | 0 | C2(=0) | ON |
| | | Tone stopping data | 48 | C2(=0) | OFF |
| 2 | D2 note inf. AS-D2 | Tone gen. data | 50 | D2(=2) | ON |
| | | Tone stopping data | 98 | D2(=2) | OFF |
| 3 | E2 note inf. AS - E2 | Tone gen. data | 100 | E2(=4) | ON |
| | | Tone stopping data | 148 | E2(=4) | OFF |
| 4 | C2 note inf. AS-C2' | Tone gen. data | 150 | C2(=0) | ON |
| | | Tone stopping data | 248 | C2(=0) | OFF |
| 5 | D2 note inf. AS-D2 | Tone gen. data | 250 | D2(=2) | ON |
| | | Tone stopping data | 298 | D2(=2) | OFF |
| 6 | E2 note inf. AS-E2' | Tone gen. data | 300 | E2(=4) | ON |
| | | Tone stopping data | 398 | E2(=4) | OFF |

FIG. 11

Accompaniment pattern inf. as in the case of the key-ON pattern shown in Fig. 2A, column 3.
Pitch name of root note: C Shift amount: 0
Chord type: M Pitch difference: 2

| | Tone inf. AS | Date | Clock data | Pitch data | ON/OFF data |
|---|---|---|---|---|---|
| 1 | D2note inf. AS-D2 | Tone gen. data | 0 | D2(=2) | ON |
| | | Tone stopping data | 48 | D2(=2) | OFF |
| 2 | D2note inf. AS-D2 | Tone gen. data | 50 | D2(=2) | ON |
| | | Tone stopping data | 98 | D2(=2) | OFF |
| 3 | D2note inf. AS-D2 | Tone gen. data | 100 | D2(=2) | ON |
| | | Tone stopping data | 148 | D2(=2) | OFF |
| 4 | D2note inf. AS-D2' | Tone gen. data | 150 | D2(=2) | ON |
| | | Tone stopping data | 248 | D2(=2) | OFF |
| 5 | D2note inf. AS-D2 | Tone gen. data | 250 | D2(=2) | ON |
| | | Tone stopping data | 298 | D2(=2) | OFF |
| 6 | D2note inf. AS-D2' | Tone gen. data | 300 | D2(=2) | ON |
| | | Tone stopping data | 398 | D2(=2) | OFF |

FIG. 12

Accompaniment pattern inf. as in the case of the key-ON pattern shown in Fig. 3A, column 1.

Pitch name of root note: C Shift amount: 0

Chord type: m Pitch difference: 0

| | Tone inf. AS | Date | Clock data | Pitch data | ON/OFF data |
|---|---|---|---|---|---|
| 1 | C2 note inf. AS-C2 | Tone gen. data | 0 | C2(=0) | ON |
| | | Tone stopping data | 48 | C2(=0) | OFF |
| 2 | D2 note inf. AS-D2 | Tone gen. data | 50 | D2(=2) | ON |
| | | Tone stopping data | 98 | D2(=2) | OFF |
| 3 | $E2^b$(=D2#) note inf. AS-$E2^b$(=D2#) | Tone gen. data | 100 | $E2^b$(=D2#)(=3) | ON |
| | | Tone stopping data | 148 | $E2^b$(=D2#)(=3) | OFF |
| 4 | C2 note inf. AS-C2' | Tone gen. data | 150 | C2(=0) | ON |
| | | Tone stopping data | 248 | C2(=0) | OFF |
| 5 | D2 note inf. AS-D2 | Tone gen. data | 250 | D2(=2) | ON |
| | | Tone stopping data | 298 | D2(=2) | OFF |
| 6 | $E2^b$(=D2#) note inf. AS-$E2^b$(=D2#) | Tone gen. data | 300 | $E2^b$(=D2#)(=3) | ON |
| | | Tone stopping data | 398 | $E2^b$(=D2#)(=3) | OFF |

FIG. 13

Accompaniment pattern inf. as in the case of the key-ON pattern shown in Fig. 3A, column 4.

Pitch name of root note : C  Shift amount : 0

Chord type : m  Pitch difference : 0

| | Tone inf. AS | Date | Clock data | Pitch data | ON/OFF data |
|---|---|---|---|---|---|
| 1 | $E2^b$(=D2#)note inf. AS-$E2^b$ (=D2#) | Tone gen. data | 0 | $E2^b$(=D2#)(=3) | ON |
| | | Tone stopping data | 48 | $E2^b$(=D2#)(=3) | OFF |
| 2 | D2 note inf. AS-D2 | Tone gen. data | 50 | D2 (=2) | ON |
| | | Tone stopping data | 98 | D2(=2) | OFF |
| 3 | G2 note inf. AS-G2 | Tone gen. data | 100 | G2(=7) | ON |
| | | Tone stopping data | 148 | G2(=7) | OFF |
| 4 | $E2^b$(=D2#) note inf. AS-$E2^b$(=D2#)' | Tone gen. data | 150 | $E2^b$(=D2#)(=3) | ON |
| | | Tone stopping data | 248 | $E2^b$(=D2#)(=3) | OFF |
| 5 | D2 note inf. AS-D2 | Tone gen. data | 250 | D2 (=2) | ON |
| | | Tone stopping data | 298 | D2 (=2) | OFF |
| 6 | G2 note inf. AS-G2' | Tone gen. data | 300 | G2 (=7) | ON |
| | | Tone stopping data | 398 | G2(=7) | OFF |

FIG. 14

Accompaniment pattern inf.as in the case of the key-ON pattern shown in Fig. 3B, column 8

Pitch name of root note: C Shift amount: 0

Chord type: m Pitch difference: 0

| | Tone inf. AS | Date | Clock data | Pitch data | ON/OFF data |
|---|---|---|---|---|---|
| 1 | G2 note inf. AS-G2 | Tone gen. data | 0 | G2(=7) | ON |
| | | Tone stopping data | 48 | G2(=7) | OFF |
| 2 | D2 note inf. AS-D2 | Tone gen. data | 50 | D2(=2) | ON |
| | | Tone stopping data | 98 | D2(=2) | OFF |
| 3 | C3 note inf. AS-C3 | Tone gen. data | 100 | C3(=12) | ON |
| | | Tone stopping data | 148 | C3(=12) | OFF |
| 4 | G2 note inf. AS-G2' | Tone gen. data | 150 | G2(=7) | ON |
| | | Tone stopping data | 248 | G2(=7) | OFF |
| 5 | D2 note inf. AS-D2 | Tone gen. data | 250 | D2(=2) | ON |
| | | Tone stopping data | 298 | D2(=2) | OFF |
| 6 | C3 note inf. AS-C3' | Tone gen. data | 300 | C3(=12) | ON |
| | | Tone stopping data | 398 | C3(=12) | OFF |

FIG. 15

Accompaniment pattern inf. as in the case of the key-ON pattern shown in Fig.4A, column 1.

Pitch name of root note: C Shift amount: 0

Chord type: dim Pitch difference: 0

| | Tone inf. AS | Date | Clock data | Pitch data | ON/OFF data |
|---|---|---|---|---|---|
| 1 | C2 note inf. AS-C2 | Tone gen. data | 0 | C2(=0) | ON |
| | | Tone stopping data | 48 | C2(=0) | OFF |
| 2 | D2 note inf. AS-D2 | Tone gen. data | 50 | D2(=2) | ON |
| | | Tone stopping data | 98 | D2(=2) | OFF |
| 3 | $E2^b$(=D2#) note inf. AS-$E2^b$(=D2#) | Tone gen. data | 100 | $E2^b$(=D2#)(=3) | ON |
| | | Tone stopping data | 148 | $E2^b$(=D2#)(=3) | OFF |
| 4 | C2 note inf. AS-C2' | Tone gen. data | 150 | C2(=0) | ON |
| | | Tone stopping data | 248 | C2(=0) | OFF |
| 5 | D2 note inf. AS-D2 | Tone gen. data | 250 | D2(=2) | ON |
| | | Tone stopping data | 298 | D2(=2) | OFF |
| 6 | $E2^b$(=D2#) note inf. AS-$E2^b$(=D2#)' | Tone gen. data | 300 | $E2^b$(=D2#)(=3) | ON |
| | | Tone stopping data | 398 | $E2^b$(=D2#)(=3) | OFF |

FIG. 16

Accompaniment pattern inf. as in the case of the key-ON pattern shown in Fig.5A, column 1.

Pitch name of root note : C  Shift amount : 0

Chord type : m7  Pitch difference : 0

| | Tone inf. AS | Date | Clock data | Pitch data | ON/OFF data |
|---|---|---|---|---|---|
| 1 | C2 note inf. AS-C2 | Tone gen. data | 0 | C2 (=0) | ON |
| | | Tone stopping data | 48 | C2 (=0) | OFF |
| 2 | D2 note inf. AS-D2 | Tone gen. data | 50 | D2 (=2) | ON |
| | | Tone stopping data | 98 | D2 (=2) | OFF |
| 3 | $E2^b$ (=D2#) note inf. AS-$E2^b$ (=D2#) | Tone gen. data | 100 | $E2^b$ (=D2#) (=3) | ON |
| | | Tone stopping data | 148 | $E2^b$ (=D2#) (=3) | OFF |
| 4 | C2 note inf. AS-C2' | Tone gen. data | 150 | C2 (=0) | ON |
| | | Tone stopping data | 248 | C2 (=0) | OFF |
| 5 | D2 note inf. AS-D2 | Tone gen. data | 250 | D2 (=2) | ON |
| | | Tone stopping data | 298 | D2 (=2) | OFF |
| 6 | $E2^b$ (=D2#) note inf. AS-$E2^b$ (=D2#)' | Tone gen. data | 300 | $E2^b$ (=D2#) (=3) | ON |
| | | Tone stopping data | 398 | $E2^b$ (=D2#) (=3) | OFF |

FIG. 17

| | Key-ON pattern (KP) | Chord type (CS) | Chord name | Chord form | Pitch name of chord root (RS) | Pitch name of chord bass (LS) | Accompaniment pattern (AS) |
|---|---|---|---|---|---|---|---|
| 1 | C3-E3-G3 | M | $C_M$ | Basic | C | C | C2 D2 E2 C2' D2 E2' |
| 2 | E3-G3-C4 | M | $C_M$ | 1st inversion | C | E | C2 D2 E2 C2' D2 E2' |
| 3 | G3-C4-E4 | M | $C_M$ | 2nd inversion | C | G | C2 D2 E2 C2' D2 E2' |

FIG. 20

PRIOR ART

| | Key-ON pattern (KP) | Chord type (CS) | Chord name | Chord form | Pitch name of chord root (RS) | Pitch name of chord bass (LS) | Accompaniment pattern (AS) |
|---|---|---|---|---|---|---|---|
| 1 | C3-E3$^b$-G3 | m | Cm | Basic | C | C | C2 D2 E2$^b$ C2' D2 E2$^b$' |
| 2 | E3$^b$-G3-C4 | m | Cm | 1st inversion | C | E$^b$ | C2 D2 E2$^b$ C2' D2 E2$^b$' |
| 3 | G3-C4-E4$^b$ | m | Cm | 2nd inversion | C | G | C2 D2 E2$^b$ C2' D2 E2$^b$' |

FIG. 21

PRIOR ART

AUTOMATIC CHORD GENERATING DEVICE FOR AN ELECTRONIC MUSICAL INSTRUMENT

BACKGROUND OF THE INVENTION

1. Field of the Invention

The present invention relates to an automatic accompaniment device for electronic musical instruments.

2. Description

Heretofore, there has been proposed such an automatic accompaniment device as disclosed in Japanese Patent Public Disclosure Gazette No. 193200/88. FIG. 19 shows the conventional automatic accompaniment device, which comprises key-ON pattern information generating means 1, chord type information generating means 2, chord root information generating means 3, accompaniment pattern information generating means 4, and accompaniment pattern note generating means 5.

Key-ON Pattern Information Generating Means 1

The key-ON pattern information generating means 1 includes a key-ON information generating circuit 11 and a key-ON pattern information generating circuit 12 and generates Key-ON pattern information KPS.

KEY-ON INFORMATION GENERATING CIRCUIT 11

The key-ON information generating circuit 11 has a keyboard 111. The keyboard 111 has a plurality of keys (identified generally by K) sequentially corresponding to a plurality of sequential pitches, for example, keys K-C1, K-C1#, K-D1, . . . , K-B1, K-C2, K-C2#, . . . , K-C6, K-B2, . . . , K-C5, K-C5#, . . . , K-B5, K-C6 corresponding to pitches C1, C1#, D1, . . . , B1, C2, C2#, B2, . . . , C5, C5#, . . . , B5, C6, respectively. In FIG. 1 there are shown the keys K-C, K-C#, K-D, . . . , K-B of only one octave for each of the pitches C1 to B1, C2 to B2, . . . , C5 to B5, for the sake of brevity.

In the case where a key-ON pattern KP is changed by the depression of a desired one or more of the keys K-C1, K-C1#, D1, . . . , K-C6 of the keyboard 111, the key-ON information generating circuit 11 generates, upon each occurrence of such a change in the key-ON pattern KP, one or more pieces of key-ON information (indicated generally by KS) which constitute the key-ON pattern KP, represent the depression of one or more keys and take the form of electrical digital signals. The key-ON information KS is represented in hexadecimal, based on MIDI (Musical Instrument Digital Interface) standards.

For example, upon each occurrence of the key-ON pattern KS by the depression of a key K-X (X=C1, C1#, . . . , C6) on the keyboard 111, the key-ON information generating circuit 11 yields key-ON information KS-X representing the depression of the key K-X.

For instance, in the case where the key-ON pattern KP by simultaneous depression of keys K-C3, K-E3 and K-G3 is obtained as shown in FIG. 20, row 1, the key-ON information generating circuit 11 responds to the key-ON pattern KP to output pieces of key-ON information KS-C3, KS-E3 and KS-G3 in a sequential order. In the case where the key-ON pattern KP by simultaneous depression of keys K-E3, K-G3 and K-C4 is obtained as shown in FIG. 20, row 2, the key-ON information generating circuit 11 responds to the key-ON pattern KP to output pieces of key-ON information KS-E3, KS-G3 and KS-C4 one after another. In the case where the key-ON pattern KP by simultaneous depression of keys K-G3, K-C4 and K-E4 is obtained as shown in FIG. 20, row 3, the circuit 11 responds to the key-ON pattern KP to output pieces of key-ON information KS-G3, KS-C4 and KS-E4 one after another.

In the case where the key-ON pattern KP by simultaneous depression of keys K-C3, K-E3♭ (=D3#) and K-G3 is obtained as shown in FIG. 21, row 1, the circuit 11 responds to the key-ON pattern KP to output pieces of key-ON information KS-C3, KS-E3♭ (=D3#) and KS-G3 one after another. In the case where the key ON pattern KP by simultaneous depression of keys K-E3♭, K-G3 and K-C4 is obtained as shown in FIG. 21, row 2, the key-ON information generating circuit 11 responds to the key-ON pattern KP to output pieces of key-ON information KS-E3♭, KS-G3 and KS-C4 in a sequential order. In the case where the key-ON pattern KP by simultaneous depression of keys K-G3, K-C4 and K-E4♭ is obtained as shown in FIG. 20, row 3, the key-ON information generating circuit 11 responds to the key-ON pattern KP to output pieces of key-ON information KS-G3, KS-C4 and KS-E4♭ one after another.

KEY-ON PATTERN INFORMATION GENERATING CIRCUIT 12

Based on the above-mentioned key-ON information KS available from the key-ON information generating circuit 11, the key-ON pattern information generating circuit 12 provides, as key-ON pattern information KPS, parallel information representing the key-ON pattern KP by bits of the same number as that of the keys depressed on the keyboard 111.

Incidentally, the key-ON pattern KP shown in FIG. 20, rows 1, 2 and 3 represent chords which are major (M) in the chord type, C major (CM) in the chord name and "C" in the pitch name of the chord root. The chord corresponding to the key-ON pattern KP in row 1 is basic in terms of its form, the chord corresponding to the key-ON pattern in row 2 is a first inversion type and the chord corresponding to the key-ON pattern KP in row 3 is a second inversion type. Further, the pitch name of the chord bass is "C" in the case of the key-ON pattern KP in row 1, "E" in the case of the key-ON pattern KP in row 2 and "G" in the case of the key-ON pattern KP in row 3.

The key-ON patterns KP shown in FIG. 21, rows 1, 2 and 3 represent chords which are minor (m) in the chord type, C minor (Cm) in the chord name and "C" in the pitch name of the chord root. The chord corresponding to the key-ON pattern in row 1 is basic in terms of its form, the chord corresponding to the key-ON pattern KP in row 2 is the first inversion type and the chord corresponding to the key-ON pattern in row 3 is the second inversion type. The pitch name of the chord bass is "C" in the case of the key-ON pattern KP in row 1, "E♭" in the case of the key-ON pattern KP in row 2 and "G" in the case of the key-ON pattern KP in row 3.

CHORD-TYPE INFORMATION GENERATING MEANS 2

Based on the key-ON pattern information KPS available from the key-ON pattern information generating means 1, the chord type information generating means 2 provides, as chord type information CS, information which represents, in the form of an electric digital signal, the type of the chord represented by the key-ON pattern KP.

For example, in the case where the key-ON pattern KP on the keyboard 111 of the key-ON information generating circuit 11 is C3-E3-G3 as shown in FIG. 20, row 1, the chord type is major (M) and information representing it is provided as the chord type information CS.

Where the key-ON pattern KP is C3-E3♭ (=D3♯)-G3 as shown in FIG. 21, row 1, the chord type is minor (m) and information representing it is provided as the chord type information CS.

The chord type information generating means 2 provides information CS through the aid of a computer.

CHORD ROOT INFORMATION GENERATING MEANS 3

Based on the key-ON pattern information KPS available from the key-ON pattern information generating means 1, the chord root information generating means 3 provides, as chord root information RS, information which represents, in the form of an electric digital signal, the pitch name of the root of the chord indicated by the key-ON pattern KP on the keyboard 111.

For example, in the cases where the key-ON pattern KP is C3-E3-G3 as shown in FIG. 20, row 1 and where the key-ON pattern KP is E3♭ (=D3♯)-G3-C4 as shown in FIG. 21, row 2, the pitch names of the roots of the both chords are "C" and information representing it is provided as the chord root information CS.

Where the pitch name of the root of the chord indicated by the key-ON pattern KP is "A", though not shown, information representing it is provided as the chord root information RS.

The chord root information RS is also provided through the aid of a computer.

ACCOMPANIMENT PATTERN INFORMATION GENERATING MEANS 4

Based on the chord type information CS from the chord type information generating means 2 and the chord root information RS from the chord root information generating means 3, the accompaniment pattern information generating means 4 provides accompaniment pattern information AS in accordance with the type and the pitch name of the root note of the chord indicated by the key-ON pattern KP as described below.

The accompaniment pattern information AS is composed of (1) one or more pieces of chord tone information AS-1 representing a tone which has the pitch name of the tone constituting the chord indicated by the key-ON pattern KP and the pitch corresponding solely to the type and the pitch name of the root note of the chord and (2) one or more pieces of non-chord tone information AS-2 representing a non-chord tone which has the pitch name of a tone other than that of the chord tone and the pitch corresponding solely to the chord type and the pitch name of the root note of the chord. These pieces of information AS-1 and AS-2 are provided in the time series corresponding to a rhythm indicated by rhythm information available from an automatic rhythm device used in combination with the automatic accompaniment device and in the order corresponding solely to the type of the chord indicated by the key-ON pattern KP and the pitch name of the root note of the chord.

A description will be given of the generation of such accompaniment pattern information AS on the assumption that the rhythm represented by the rhythm information from the automatic rhythm device is "8 beat".

In the cases where the key-ON pattern KP on the keyboard 111 of the key-ON information generating means 11 forming the key-ON pattern information generating means 1 is the afore-mentioned patterns such as shown in FIG. 20, rows 1, 2 and 3, respectively, the notes constituting the chords representing are: C3, E3 and G3; E3, G3 and C4; and G3, C4 and E4. Thus, the pitch names of the notes constituting the chords represented by the patterns are "C", "E" and "G", the types of the chords represented by the patterns are all major (M), and the pitch names of the chord roots are all "C".

In this instance, as shown in FIG. 20, rows 1, 2 and 3, the accompaniment pattern information AS is composed of (a) chord tone information AS-1 which includes (1) a piece of C2 note information AS-C2 representing the pitch of a note C2 and the time length of an eighth note, (2) a piece of E2 note information AS-E2 representing the pitch of a note E2 and the time length of the eighth note, (3) a piece of C2 note information AS-C2' representing the pitch of a note C2 and the time length of a quarter note and (4) a piece of E2 note information AS-E2' representing a note E2 and the time length of the quarter note, and (b) non chord tone information AS-2 which includes two pieces of D2 note information representing a note D2 and the time length of the eighth note. These pieces of information are arranged in the order (AS-C2)-(AS-D2)-(AS-E2)-(AS-C2')-(AS-D2)-(AS-E2').

In the cases where the key-ON pattern KP is the afore-mentioned patterns such as shown in FIG. 21, rows 1, 2 and 3, respectively, the notes constituting the chords representing the patterns are: C3, E3♭ (=D3♯) and G3; E3♭ (=D3♯), G3 and C4; and G3, C4 and E4♭ (=D4♯). Thus the pitch names of the notes constituting the chords represented by the patterns are "C", "E♭ (=D♯)", and "G", the type of the chords represented by the patterns are all minor (m) and the pitch names of the chords roots are all "C".

In this instance, as shown in FIG. 21, rows 1, 2 and 3, the accompaniment pattern information AS is composed of (a) chord tone information AS-1 which includes (1) a piece of C2 note information AS-C2 representing the pitch of the note C2 and the time length of the eighth note, (2) a piece of E2♭ (=D2♯) note information AS-E2♭ (=D2♯) representing the pitch of the note E2♭ (=D2♯) and the time length of the eighth note, (3) a piece of C2 note information AS-C2' representing the pitch of the note C2 and the time length of the quarter note and (4) a piece of E2♭' (=D2♯') note information AS-E2♭' (=D2♯') representing the pitch of the note E2♭ (=D2♯) and the time length of the quarter note, and (b) non chord tone information AS-2 which includes two pieces of D2 note information representing the pitch of the note D2 and the time length of the eighth note. These pieces of information are arranged in the order (AS-C2)-(AS-D2)-(AS-E2♭ (=D2♯)-(AS-C2')-(AS-D2)-(AS-E2♭' (=D2♯').

The generation of the accompaniment pattern information is also effected through the aid of a computer.

ACCOMPANIMENT PATTERN NOTE GENERATING MEANS 5

The accompaniment pattern note generating means 5 has tone generator (not shown) which generates a tone having the pitch and the time length represented by each of the pieces of tone information (such as C2 tone information AS-C2, E2 tone information AS-E2, etc.) forming the accompaniment pattern information AS. An accompaniment pattern note SS, based on the accompaniment pattern represented by the accompaniment pattern information AS from the accompaniment pattern information generating means 4, is generated by the tone generator. This is also done by the aid of a computer.

OPERATIONAL EFFECT OF THE CONVENTIONAL AUTOMATIC ACCOMPANIMENT DEVICE

According to the conventional automatic Accompaniment device described above, once the key-ON pattern information KS is generated by obtaining, from the key-ON pattern information generating means 1, the key-ON pattern KP as a pattern representing a chord on the keyboard 111 of the key-ON information generating circuit 11, the accompaniment pattern information AS corresponding to the key-ON pattern KP is automatically provided from the accompaniment pattern information generating means 4 and then the accompaniment pattern note SS based on the accompaniment pattern represented by the accompaniment pattern information AS is generated by the accompaniment pattern note generating means 5.

Further, since the accompaniment pattern information AS available from the accompaniment pattern information generating means 4 is composed of the chord tone information AS-1 representing a tone which has the pitch name of a tone constituting the chord indicated by the key-ON pattern KP and non-chord-tone information AS-2 representing a non chord tone which has the pitch name of a tone other than that of the chord tone, and since these pieces of information AS-1 and AS-2 are arranged in the time series corresponding to the rhythm represented by the rhythm information available from the automatic rhythm device and in the order corresponding to the type of the chord represented by the key-ON pattern KP and the pitch name of the chord root, the accompaniment pattern note SS is richer in sound than in the case where the accompaniment pattern information AS is composed only of the chord tone information AS-1.

PROBLEM THAT THE INVENTION IS TO SOLVE

Defects of the Prior Art

With the conventional automatic accompaniment device described above with respect to FIG. 19, however, the accompaniment pattern information AS is obtained from the accompaniment pattern information generating means 4, based only on the chord type information CS from the chord type information generating means 2 and the chord root information RS from the chord root information generating means 3.

On this account, so long as the chord represented by key-ON pattern KP on the keyboard 111 of the key-ON information generating circuit 11 remains unchanged in both of the chord type and the pitch name of the chord root, the accompaniment pattern information AS is provided in the same pattern, even if the lowest note of the chord represented by the key-ON pattern KP changes.

That is, in the cases of such key-ON pattern KP as shown in FIG. 20, rows 1, 2 and 3, they are common in the chord type (major (M)) and the pitch name of the chord root ("C"); hence, the accompaniment pattern information AS is provided in the same pattern, as shown in rows 1, 2 and 3, although they differ in the pitch name of the chord base, i.e. "C" in the case of row 1, "E" in the case of row 2 and "G" in the case of row 3.

In the case of such key-ON pattern KP as shown in FIG. 21, rows 1, 2 and 3, they are common in the chord type (minor (m)) and the pitch name of the chord root ("C"); hence, the accompaniment pattern information AS of the same pattern is provided in these cases as shown in rows 1, 2 and 3, although the key-ON pattern KP differ in the pitch name of the chord bass, i.e. "C" in the case of row 1, "E♭ (=D♯)" in the case of row 2 and "G" in the case of row 3.

Thus, according to the conventional automatic accompaniment device, accompaniment pattern notes SS rich in sound can be produced, based on the accompaniment pattern information AS which is composed of the chord tone information AS-1 and the non-chord-tone information AS-2, but the accompaniment pattern notes SS are not fully satisfactory.

OBJECT OF THE INVENTION

It is therefore an object of the present invention to provide a novel automatic accompaniment device free from the above-mentioned defect of the prior art.

MEANS FOR SOLVING THE PROBLEM

The automatic accompaniment device of the present invention includes: (1) chord type information generating means for generating chord type information representing the type of a chord; (2) a chord root information generating means for generating chord root information representing the pitch name of the root note of the chord; (3) chord bass information generating means for generating chord bass information representing the pitch name of the lowest note of the chord; and (4) accompaniment pattern information generating means for generating accompaniment pattern information based on the chord type information, the chord root information and the chord bass information. The accompaniment pattern information is composed of chord tone information which represents a chord tone of the pitch name of a note constituting the chord and non-chord-tone information which represents a non chord tone of the pitch name of a note other than the note constituting chord. The chord tone information changes, in the pitch name of the chord tone, with the pitch name of the lowest note of the chord. The non-chord-tone information does not change, in the pitch name of the chord tone, with the pitch name of the lowest note of the chord.

ACTION AND EFFECT

With the automatic accompaniment device of the present invention, it is possible to obtain, from the accompaniment pattern information generating means, an accompaniment pattern information on the basis of which is obtainable the same accompaniment pattern as that obtainable with the afore-mentioned conventional automatic accompaniment device, simply by generating, with the key-ON pattern information generating means, the same key-ON pattern information as described above with respect to the conventional device.

Furthermore, as is the case with the conventional automatic accompaniment device, the accompaniment pattern information available from the accompaniment pattern information generating means includes the chord tone information which represents a tone of the pitch name of a tone constituting the chord indicated by the key-ON pattern information and the non-chord-tone information which represents a tone of the pitch name of the chord constituting tone, and these pieces of information are arranged in desired time series. Hence, the accompaniment pattern information is obtained as information which permits the generation of accompaniment pattern note richer in sound than in the case where the accompaniment pattern information is composed only of the chord tone information.

According to the present invention, the accompaniment pattern information is obtained from the accompaniment pattern information generating means, based on the chord type information, chord root information and the chord bass information.

On this account, even if the chord type and the chord root remain unchanged, but if the pitch name of the lowest note of the chord changes, the accompaniment pattern information changes accordingly.

Thus, it is possible, with the automatic accompaniment device of the present invention, to obtain the accompaniment pattern information as information which ensures the generation of accompaniment notes richer in sound than in the prior art.

According to the present invention, the accompaniment pattern note can be made much richer, because the chord tone information of the accompaniment pattern information changes, in the pitch name of the chord tone, with the pitch name of the lowest note of the chord but the non-chord-tone information does not change, in the pitch name of the chord tone, with the pitch name of the lowest note of the chord.

BRIEF DESCRIPTION OF THE DRAWINGS

FIGS. 2A, 2B; 3A, 3B; 4A, 4B; 5A, and 5B are examples of accompaniment patterns.

FIG. 6 is a table showing the correspondence between pitch names and decimal numbers.

FIGS. 10 to 17 are tables relating to accompaniment patterns of FIGS. 2A–5B.

FIGS. 20 and 21 are examples of accompaniment patterns according to prior art.

DESCRIPTION OF THE PREFERRED EMBODIMENT

Figure 1:
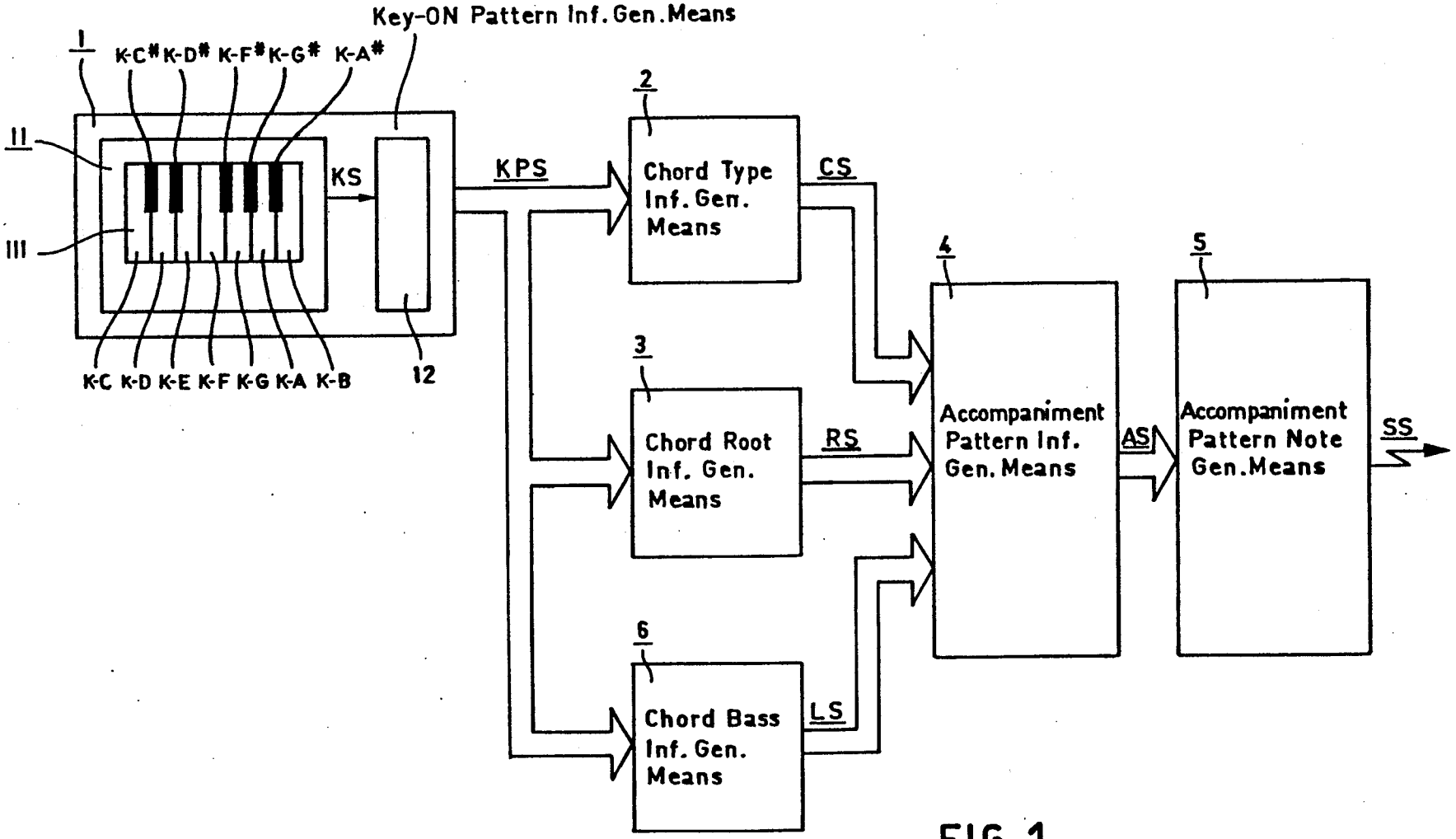
FIG. 1 is a main solution of the device according to the invention.
Figure 19:
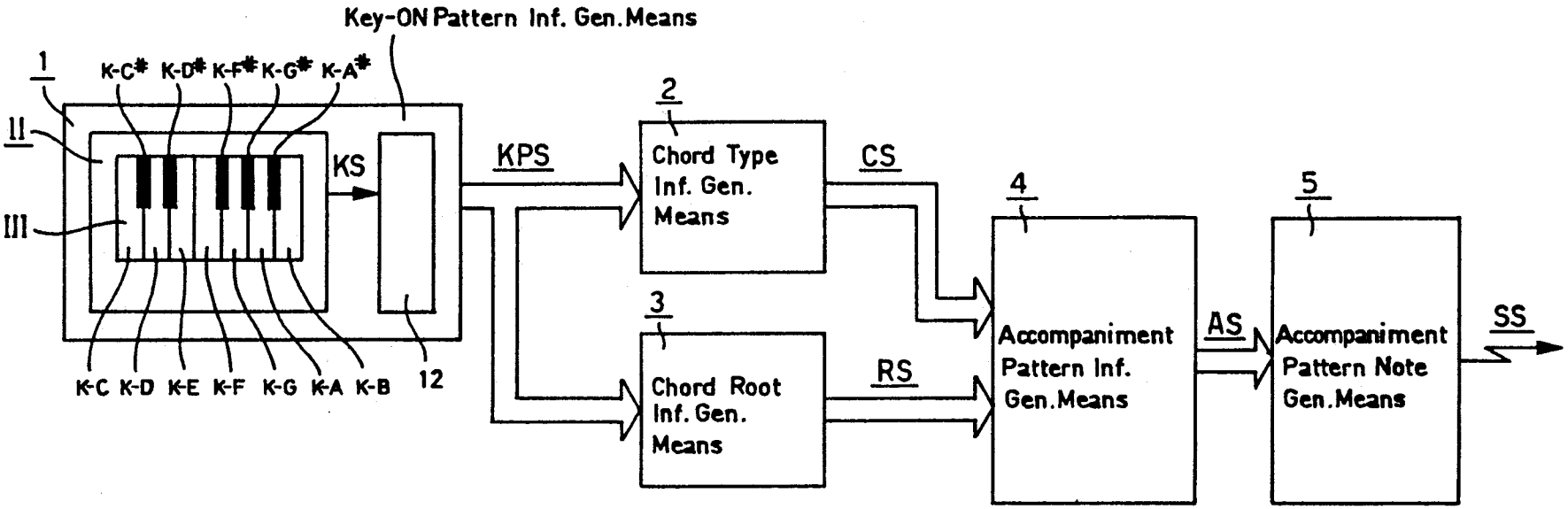
FIG. 19 PRIOR ART
FIG. 19 is a standard device according to prior art.

FIG. 1 schematically illustrates an embodiment of the automatic accompaniment device according to the present invention, in which the parts corresponding to those in FIG. 19 are identified by the same reference numerals.

As is the case with the afore-mentioned conventional automatic accompaniment device, this embodiment includes the key-ON pattern information generating means 1, the chord type information generating means 2, the chord root information generating means 3, the accompaniment pattern information generating means 4 and the accompaniment pattern tone generating means 5, and this embodiment further includes chord bass information generating means 6.

KEY-ON PATTERN INFORMATION GENERATING MEANS 1

The key-ON pattern information generating means 1 has the key-ON information generating circuit 11 and the key-ON pattern information generating circuit 12 and generates key-ON pattern information KPS, described previously.

The key-ON information generating circuit 11 includes the keyboard 111 which has the keys K-C1, K-C1#, K-D1, . . . , K-C6 sequentially corresponding to the sequential pitches C1, C1# D1, . . . , C6. Upon each occurrence of a change in the key-ON pattern KP by the depression of one or more of the keys K-C1 to K-C6 in the keyboard 111, the key-ON information generating circuit 11 generates a piece or pieces of key-ON information KS which indicate the depression of one or more keys and constitute the key-ON pattern KP.

For example, each time the key-ON pattern KP is changed by the depression of the key K-X (where X=C1, C1#, . . . , C6) in the keyboard 111, the key-ON information generating circuit 11 creates key-ON information KS-X which indicates the depression of the key K-X and constitutes the key-ON pattern KP thus changed, as described previously with respect to FIG. 19.

Now a description will be given, with reference to FIGS. 2A–5B, of the generation of the key-ON information KS by the key-ON information generating circuit 11.

For instance, upon each occurrence of a change in the key-ON pattern KP by concurrent depression of the keys K-C3, K-E3 and K-G3 of the keyboard 111 as shown in FIG. 2A, row 1, item "key-ON pattern (KP)", pieces of key-ON information KS-C3, KS-E3 and KS-G3 are generated one after another. Upon each occurrence of a change in the key-ON pattern KP by concurrent depression of the keys K-D3, K-E3, K-G3 and K-C4 as shown in FIG. 2A, row 3, pieces of key-ON information KS-D3, KS-E3, KS-G3 and KS-C4 are generated one after another. Upon each occurrence of a change in the key-ON pattern KP by concurrent depression of the keys K-E3, K-G3 and K-C4 as shown in FIG. 2A, row 5 pieces of key-ON information KS-E3, KS-G3 and KS-C4 are generated one after another. Upon each occurrence of a change in the key-ON pattern KP by concurrent depression of the keys K-G3, K-C4 and K-E4 as shown in FIG. 1, row 8, pieces of information KS-G3, KS-C4 and KS-E4 are generated one after another.

Upon each occurrence of such a change in the key-ON pattern KP by concurrent depression of the keys K-C3, K-E3♭ (=D3#) and K-G3 of the keyboard 111 as shown in FIG. 3A row 1, pieces of key-ON information KS-C3, KS-E3♭ (=D3#) and KS-G3 are generated one after another. Upon each occurrence of a change in the key-ON information KP by concurrent depression of the keys K-D3, K-E3♭ (=D3#), K-G3 and K-C4 as shown in FIG. 3A, row 3, pieces of key-ON information KS-D3, KS-E3♭ (=D3#), KS-G3 and KS-C4 are generated one after another. Upon each occurrence of a change in the key-ON pattern KP by concurrent depression of the keys K-E3♭ (=D3#), G3 and C4 as shown in FIG. 3A, row 4, pieces of key-ON information KS-E3♭ (=D3#), KS-G3 and KS-C4 are generated one after another. Upon each occurrence of a change in the key-ON pattern KP by concurrent depression of the keys K-G3, K-C4 and K-E4♭ (=D4♯) as shown in FIG. 3A, row 8, pieces of key-ON information KS-G3, KS-C4 and KS-E4♭ (=D4♯) are generated one after another.

Upon each occurrence of a change in the key-ON pattern KP by concurrent depression of the keys K-C3, K-E3♭ (=D3♯), K-G3♭ (=F3♯) and K-A3 as shown in FIG. 4B, row 1, pieces of key-ON information KS-C3, KS-E3♭ (=D3♯), KS-G3♭ (=F3♯) and KS-A3 are generated one after another. Upon each occurrence of a change in the key-ON information KP by concurrent depression of the keys K-E3♭ (=D3♯), K-G3♭ (=F3♯), K-A3 and K-C4 as shown, in FIG. 4A, row 4, pieces of information KS-E3♭ (=D3♯), KS-G3♭ (=F3♯), KS-A3 and KS-C4 are generated one after another. Upon each occurrence of a change in the key-ON pattern KP by concurrent depression of the keys K-G3♭, K-A3, K-C4 and K-E4♭ as shown in FIG. 4A, row 7, pieces of key-ON information KS-G3♭ (=F3♯), KS-AS, KS-C4 and KS-E4♭ are generated one after another. Upon each occurrence of a change in the key-ON information KP by concurrent depression of the keys K-K-A3, K-C4, K-E4♭ and K-G4♭ as shown in FIG. 4B, row 10, pieces of information KS-A3, KS-C4, KS-E4♭ and KS-G4♭ are generated one after another.

Upon each occurrence of a change in the key-ON pattern KP by concurrent depression of the keys K-C3, K-E3♭ (=D3♯), K-G3 and K-B3♭ (=A3♯) as shown in FIG. 5A, row 1, pieces of key-ON information KS-C3, KS-E3♭ (=D3♯), KS-G3 and KS-B3♭ (=A3♯) are generated one after another. Upon each occurrence of a change in the key-ON pattern KP by concurrent depression of the keys K-D3, K-E3♭ (=D3♯), K-G3 and K-B3♭ (=A3♯) as shown in FIG. 5A, row 3, pieces of key-ON information KS-D3, KS E3♭ (=D3♯), KS-G3 and KS-B3♭ (=A3♯) are generated one after another. Upon each occurrence of a change in the key-ON pattern KP by concurrent depression of the keys K-E3♭ (=D3♯), K-G3, K-B3♭ (=A3♯) and K-C4 as shown in FIG. 5A, row 4, pieces of key-ON information KS-E3♭ (=D3♯), KS-G3, KS-B3♭ (=A3♯) and KS-C4 are generated one after another. Upon each occurrence of a change in the key-ON pattern KP by concurrent depression of the keys K-G3, K-G3, KC4 and K-E4♭ as shown in FIG. 5B, row 8, pieces of key-ON information KS-G3, KS-G3♭, KS-C4 and KS-E4 are generated one after another.

Upon each occurrence of a change in the key-ON pattern KP by concurrent depression of the keys K-B3♭, K-C4, K-E4♭ and K-G4 as shown in FIG. 5B row 11, pieces of key-ON information KS-B3♭, KS-C4, KS-E4 and KS-G4 are generated one after another.

The above-described generation of the key-ON information KS by the key-ON information generating circuit 11 is carried out with the aid of a computer as described later on.

KEY-ON PATTERN INFORMATION GENERATING CIRCUIT 12

As in the case with the conventional automatic accompaniment device, the key-ON pattern information generating circuit 12 is supplied with the key-ON information KS from the key-ON information generating circuit 11 and generates key-ON pattern information KPS, based on the information KS. The key-ON pattern information KPC is parallel information which represents the key-ON pattern KP of the keyboard 111 by bits of the same number as the keys of the keyboard 111.

Incidentally, the key-ON patterns shown in FIG. 2B row 8, item "key-ON pattern KP" each represent a chord which is major (M) in chord type, C major (CM) in chord name (however, the chord name of the key-ON pattern in row 3 is also referred to as C add 9th.) and "C" in pitch name of the chord root, as shown in items "Chord Type", "Chord Name" and "Pitch Name of Chord Root", respectively. This chord assumes the basic form for the key-ON pattern KP shown in row 1, a special form for the key-ON pattern KP in row 3, a first inversion form for the key-ON pattern KP in row 5, and a second inversion form for the key-ON pattern KP in row 8. The pitch name of the chord bass is "C" for the key-ON pattern KP shown in row 1, "D" for the key-ON information KP in row 3, "E" for the key-ON pattern KP in row 5, and "G" for the key-ON pattern KP in row 8.

The key-ON patterns shown in FIG. 3A, rows 1, 3, and 4, item "Key-ON Pattern KP" each represent a chord which is minor (m) in chord type, C minor (Cm) in chord name and "C" in pitch name of the chord root. This chord assumes the basic form for the key-ON pattern KP shown in row 1, a special form for the key-ON pattern KP in row 3, a first inversion form for the key-ON pattern KP in row 4 and a second inversion form for the key-ON pattern KP in row 8. The pitch name of the chord bass is "C" for the key-ON pattern KP shown in row 1, "D" for the key-ON pattern KP in row 3, "E♭" (="D♯") for the key-ON pattern KP in row 4, and "G" for the key-ON pattern KP in row 4.

The key-ON pattern KP shown in FIG. 4A, rows 1, and 4, and FIG. 4B rows 7 and 10 each represent a chord which is diminished (dim) in chord type, C diminished (Cdim) in chord name and "C" in pitch name of the chord root. The mode of the chord is the basic mode in the case of key-ON pattern KP shown in row 1. In the case of the key-ON pattern shown in row 4, the mode of the chord is the basic mode of the diminished chord which uses, as the pitch name of its root note, the pitch name "E♭ (=D♯)" of a note three semitones higher than the note of the pitch name "C" which is the root note of the chord represented by the pattern. In the case of the key-ON pattern shown in row 7, the mode of the chord is the basic mode of the diminished chord which uses, as the pitch name of its root note, the pitch name "G♭ (=F♯)" of a note six semitones higher than the note of the pitch name "C" which is the root note of the chord represented by the pattern. In the case of the key-ON pattern shown in row 10, the mode of the chord is the basic mode of the diminished chord which uses, as the pitch name of its root note, the pitch name "A" of a note nine semitones higher than the note of the pitch name "C" which is the note of the chord represented by the pattern. The pitch name of the chord bass is "C" for the key-ON pattern KP shown in row 1, "E♭" (="D♯") for the key-ON pattern KP in row 4, "G♭" (="F♯") for the key-ON pattern KP in row 7 and "A" for the key-ON pattern KP in row 10.

The key-ON patterns KP shown in FIG. 5A, rows 1, 3, and 4, and FIG. 5B, rows 8 and 11 each represent a chord which is minor 7th (m7) in chord type, C minor 7th (Cm7) in chord name and "C" in pitch name of the chord root. The mode of the chord is the basic mode in the case of the key-ON pattern shown in row 1. In the case of the key-ON pattern KP shown in row 3, the mode of the chord is neither the basic nor inversion mode but a special mode. In the case of the key-ON pattern KP shown in row 4, the mode of the chord is the basic mode of a sixth chord which uses, as the pitch name of its root note, the pitch name "E♭ (=D♯)" of a note three semitones higher than the note of the pitch name "C" which is the root note of the chord represented by the pattern. In the case of the key-ON patterns KP shown in rows 8 and 11, the modes of the chords are first, second and third inversion modes, respectively. The pitch name of the chord bass is "C" for the key-ON pattern KP shown in row 1 and "D", "E♭" (="D♯"), "G" and "B♭" (="A♯") for the key-ON patterns in rows 3, 4, 8 and 11, respectively.

CHORD TYPE INFORMATION GENERATING MEANS 2

As in the afore-mentioned prior art device, the chord type information generating means 2 is supplied with the key-ON pattern information KPS from the key-ON pattern information generating means 1 and generates chord type information CS, based on the information KPS. The chord type information CS represents, in the form of an electric digital signal, the chord type represented by the key-ON pattern KP in the keyboard 111 of the key-ON information generating circuit 1.

For instance, when the key-ON pattern KP in the keyboard 111 of the key-ON information generating circuit 11 is such a pattern as shown in FIG. 2A, row 1, 3, 4 or 5 or FIG. 3B, row 8, the chord type represented by the pattern is major (M) and such information is provided as the chord type information CS.

When the key-ON pattern KP is such a pattern as shown in FIG. 3A, row 1, 3, 4, or 5 or FIG. 3B, row 8 the chord type represented by the pattern is minor (m) and such information is provided as the chord type information CS.

When the key-ON pattern KP is such a pattern as shown in FIG. 4A, row 1 or 4 and FIG. 4B, row 7 or 10, the chord type represented by the pattern is diminished (dm) and such information is provided as the chord type information CS.

When the key-ON pattern KP is such a pattern as shown in FIG. 5A, row 1, 3 or 4 and FIG. 5B, row 8 or 11, the chord type represented by the pattern is minor 7th (m7) and such information is provided as the chord type information CS.

The generation of the chord type information CS by the chord type information generating means 2 is computer-aided as described later on.

CHORD ROOT INFORMATION GENERATING MEANS 3

As in the afore-mentioned prior art device, the chord root information generating means 3 is also supplied with the key-ON pattern information KPS from the key-ON information generating means 1 and generates chord root information RS, based on the information KPS. The chord root information RS represents, in the form of an electric digital signal, the pitch name of chord root of the key-ON pattern KP in the keyboard 111 of the key-ON information generating circuit 11 forming the key-ON pattern information generating means 1.

For example, in the case when the key-ON pattern KP is such a pattern as shown in FIG. 2A, rows 3, 4 or 5, the pitch name of the chord root expressed by such a pattern is "C" and such information is provided as the chord root information RS.

Moreover, where the pitch name of the chord root indicated by the key-ON pattern KP is "A", such information is provided as the chord root information RS, though not shown in FIGS. 2A through 5B.

The generation of the chord root information RS from the chord root information generating means 3 is also computer-aided as will be described later.

CHORD BASS INFORMATION GENERATING MEANS 6

It must be noted here that the traditional automatic accompaniment device described previously with respect to FIG. 19 does not include either the chord bass information generating means 6 or the corresponding means.

The chord bass information generating means 6 is also supplied with the key-ON pattern information KPS from the key-ON pattern information generating means 1 and generates chord bass information LS, based on the information KPS. The chord bass information LS represents, in the form of an electric digital signal, the pitch name of the chord bass indicated by the key-ON pattern KP in the keyboard 111.

For instance, in the case where the key-ON pattern KP is the pattern as shown in FIG. 2A, row 1, 3, or 5, or FIG. 2B, row 8, the pitch name of the chord bass represented by the pattern is "C", "D", "E", or "G" and such information is provided as the chord bass information LS.

When the key-ON pattern KP is the pattern as shown in FIG. 3A, rows 1, 3, or 4 or FIG. 3B, row 8, the pitch name of the chord bass represented by the pattern is "C", "D", "E♭ (=D♯)" or "G" and such information is provided as the chord bass information LS.

When the key-ON pattern KP is the pattern as shown in FIG. 4A, rows 1 or 4 or FIG. 4B, rows 7 or 10, the pitch name of the chord bass represented by the pattern is "C", "E♭", "G3♭" or "A" and such information is provided as the chord bass information LS.

When the key-ON pattern KP is the pattern as shown in FIG. 5A, rows 1, 3, or 4 or FIG. 5A, rows 8 or 11, the pitch name of the chord bass represented by the pattern is "C", "D", "E♭", "G" or "B♭" and such information is provided as the chord bass information LS.

The generation of the chord bass information LS by the chord bass information generating means 6 is also computer-aided as will be described later on.

ACCOMPANIMENT PATTERN INFORMATION GENERATING MEANS 4

The accompaniment pattern information generating means 4 of the present invention corresponds to the accompaniment pattern information generating means 4 of the aforementioned prior art device but provides the accompaniment pattern AS in a different form as described below.

Based on the chord type information CS from the chord type information generating means 2, the chord root information RS from the chord root information generating means 3 and the chord bass information LS from the chord bass information generating means 3, the accompaniment pattern information generating means 4 generates the accompaniment pattern information AS in accordance with the type and the pitch names of the root note and the bass or the lowest note of the chord indicated by the key-ON pattern KP in the keyboard 111 of the key-ON information generating circuit 11 forming the key-ON pattern information generating means 1.

Unlike the accompaniment pattern information AS available from the accompaniment pattern information generating means 4 in the conventional automatic accompaniment device, the accompaniment pattern information AS in the present invention is composed of (1) chord tone information AS-1 representing a chord tone which has the pitch name of a tone constituting the chord indicated by the key-ON pattern KP and the pitch corresponding to the chord type and the pitch names of the root note and the bass or lowest tone of the chord and (2) non chord tone information AS-2 representing a non chord tone which has the pitch name of a tone other than that of the above-said chord tone and the pitch corresponding to the chord type and the pitch names of the root note and the bass or lowest tone of the chord. In this instance, respective pieces of information AS-1 and AS-2 are arranged in the time series corresponding to the rhythm specified by rhythm information from an automatic rhythm device associated with the automatic accompaniment device and in the order corresponding to the chord type and the pitch names of the root tone and the bass or lowest tone of the chord specified by the key-ON pattern KP.

GENERATION OF ACCOMPANIMENT PATTERN INFORMATION AS

A description will be given of the generation of such accompaniment pattern information AS on the assumption that the rhythm represented by the rhythm information from the automatic rhythm device is "8 beat".

WHEN THE CHORD TYPE IS MAJOR (M)

In the case where the key-ON pattern KP in the keyboard 111 is C3-E3-G3 as shown in FIG. 2A, row 1, the component notes of the chord specified by the pattern are C3, E3 and G3 and consequently their pitch names are "C", "E" and "G", the chord type is major (M), the pitch name of the chord root is "C", and the pitch name of the chord bass (or lowest note) is "C".

In this instance, as shown in FIG. 2A, row 1, "Accompaniment Pattern", the accompaniment pattern AS is composed of (a) the chord tone information AS-1 which includes (1) a piece of C2 note information AS-C2 representing the pitch of the note C2 and the time length of an eighth note, (2) a piece of E2 note information AS-E2 representing the pitch of the note E2 and the time length of the eighth note, (3) a piece of C2 note information AS-C2' representing the pitch of the note E2 and the time length of a quarter note and (4) a piece of E2 note information AS-E2' representing the pitch of the note E2 and the time length of the fourth note, and (b) the non-chord tone information AS-2 which includes (1) two pieces of D2 note information AS-D2 representing the pitch of the note D2 and the time length of the eighth note. These pieces of information are arranged in the order (AS-C2)-(AS-D2)-(AS-E2)-(AS-C2')-(AS-D2)-(AS-E2').

In the case where the key-ON pattern KP in the keyboard 111 is D3-E3-G3-C4 as shown in FIG. 2A, row 3, the component notes of the chord specified by the pattern are D3, E3, G3 and C4 and consequently their pitch names are "C", "D", "E" and "G", the chord type is major (M), the pitch name of the chord root is "C" and the pitch name of the chord bass (or lowest note) is "D".

In this instance, the accompaniment pattern information AS is composed of non-chord tone information AS-2 which includes four pieces of D2 note information AS-D2 representing the pitch of the note D2 and the time length of an eighth note and two pieces of D2 note information AS-D2' representing the pitch of the note D2 and the time length of a quarter note. Three pieces of D2 note information AS-D2, one piece of D2 note information AS-D2', one piece of D2 note information AS-D2 and one piece of D2 note information AS-D2' are arranged in this order.

In the case where the key-ON pattern KP is E3-G3-C4 as shown in FIG. 2A, row 5, the component notes of the chord specified by the pattern are E3, G3 and C4 and consequently their pitch names "E", "G" and "C", the chord type is major (M), the pitch name of the chord root is "C" and the pitch name of the chord bass (or lowest note) is "E".

In this instance, the accompaniment pattern information AS is composed of (a) chord tone information AS-1 which includes (1) a piece of E2 note information AS-E2 representing the pitch of the note E2 and the time length of the eighth note, (2) a piece of G2 note information AS-G2 representing the pitch of the note G2 and the time length of the eighth note, (3) a piece of E2 note information AS-E2' representing the pitch of the note E2 and the time length of the quarter note and (4) a piece of G2 note information AS-G2' representing the pitch of the note G2 and the time length of the quarter note, and (b) the non-chord tone information AS-2 which includes two pieces of D2 note information AS-D2 representing the pitch of the note D2 and the time length of the eighth note. These pieces of information are arranged in the order (AS-E2)-(AS-D2)-(AS-G2)-(AS-E2')-(AS-D2)-(AS-G2').

In the case where the- key-ON pattern KP is G3-C4-E4 as shown in FIG. 2B, row 8, the component notes of the chord represented by the pattern are G3, C4 and E4 and consequently their pitch names are "G", "C" and "E", the chord type is major (M), the pitch name of the chord root is "C" and the pitch name of the chord bass (or lowest note) is "G".

In this instance, the accompaniment pattern information AS is composed of (a) the chord tone information AS-1 which includes (1) a piece of G2 note information AS-G2 representing the pitch of the note G2 and the time length of an eighth note, (2) a piece of C3 note information AS-C3 representing the pitch of the note C3 and the time length of the eighth note, (3) a piece of G2 note information AS-G2' representing the pitch of the note G2 and the time length of a quarter note and (4) a piece of C3 note information AS-C3' representing the pitch of the note C3 and the time length of the quarter note, and (b) the non-chord tone information AS-2 which includes two pieces of D2 note information AS-D2 representing the pitch of the note D2 and the time length of the eighth note. These pieces of information are arranged in the order (AS-G2)-(AS-D2)-(AS-C3)-(AS-G2')-(AS-D2)-(AS-C3').

WHERE CHORD TYPE IS MINOR (m)

In the case where the key-ON pattern KP is C3-E3♭ (=D3♯)-G3 as shown in FIG. 3A, row 1, the component notes of the chord represented by the pattern are C3, E3♭ (=D3♯) and G3 and consequently their pitch names are "C", "E♭ (=D♯)" and "G", the chord type is minor (m), the pitch name of the chord root is "C" and the pitch name of the chord bass is "C".

In this instance, the accompaniment pattern information AS is composed of (a) the chord tone information AS-1 which includes (1) a piece of C2 note information AS-C2 representing the pitch of the note C2 and the time length of an eighth note, (2) a piece of E2♭ (=D2♯) note information AS-E2♭ (=D2♯) representing the pitch of the note E2♭ (=D2♯) and the time length of the eighth note, (3) a piece of C2 note information AS-C2' representing the pitch of the note C2 and the time length of a quarter note and (4) a piece of E2♭ (=D2♯) note information AS-E2♭' (=D2♯') representing the pitch of the note E2♭ (=D2♯) and the time length of the quarter note, and (b) the non-chord tone information AS-2 which includes two pieces of D2 note information AS-D2 representing the pitch of the note D2 and the time length of the eighth note. These pieces of information are arranged in the order (AS-C2)-(AS-D2)-(AS-E2♭ (=D2♯))-(AS-C2')-(AS-D2)-(AS-E2♭'=D2♯').

In the case where the key-ON pattern KP is D3-E3♭ (=D3♯)-G3-C4 as shown in FIG. 3A, row 3, the component notes of the chord indicated by the pattern are D3, E3♭ (=D3♯), G3 and C4 and consequently their pitch names are "D", "E♭ (=D♯)", "G" and "C", the pitch name of the chord root is "C" and the pitch name of the chord bass is "D".

In this instance, the accompaniment pattern AS is composed of the non-chord tone information AS-2 which includes four pieces of D2 note information AS-D2 representing the pitch of the note D2 and the time length of an eighth note and two pieces of D2 note information AS-D2' representing the pitch of the note D2 and the time length of a quarter note. Three pieces of D2 note information AS-D2, one piece of D2 note information AS-D2', one piece of D2 note information AS-D2 and one piece of D2 note information AS-D2' are arranged in this order.

In the case where the key-ON pattern KP is E3♭ (=D3♯)-G3-C4 as shown in FIG. 3A, row 4, the component notes of the chord represented by the pattern are E3♭ (=D3♯), G3 and C4 and consequently their pitch names are "E♭ (=D♯)", "G" and "C", the chord type is minor (m), the pitch name of the chord root is "C" and the pitch name of the chord bass is "E♭ (=D♯)".

In this instance, the accompaniment pattern information AS is composed of (a) chord tone information AS-1 which includes (1) a piece of E2♭ (=D2♯) note information AS-E2♭ (=D2♯) representing the pitch of the note E2♭ (=D2♯), (2) a piece of G2 note information AS-G2 representing the pitch of the note G2 and the time length of an eighth note, (3) a piece of E2♭ (=D2♯) note information AS-E2♭' (=D2♯') representing the pitch of the note E2♭ (=D2♯) and the time length of a quarter note and (4) one piece of G2 note information AS-G2' representing the pitch of the note G2 and the time length of the quarter note, and (b) non-chord tone information AS-2 which includes two pieces of D2 note information representing the pitch of the note D2 and the time length of the eighth note. Then, these pieces of information are arranged in the order (AS-E2♭ (=D2♯))-(AS-D2)-(AS-G2)-(AS-E2♭ (=D2♯))-(AS-D2)-(AS-G2').

In the case where the key-ON pattern KP is G3-C4-E4♭ (=D4♯) as shown in FIG. 3B, row 8, the component notes of the chord indicated by the pattern are G3, C4 and E4♭ (=D4♯) and consequently their pitch names are "G", "C" and "E♭ (=D♯)", the chord type is minor (m), the pitch name of the chord root is "C" and the pitch name of the chord bass is "G".

In this instance, the accompaniment pattern AS is composed of (a) chord tone information AS-1 which includes (1) a piece of G2 note information AS-G2 representing the pitch of the note G2 and the time length of an eighth note, (2) a piece of C3 note information AS-C3 representing the pitch of the note G3 and the time length of an eighth note, (3) a piece of G2 note information AS-G2' representing the pitch of the note G2 and the time length of a quarter note and (4) a piece of C3 note information AS-C3' representing the pitch of the note C3 and the time length of the quarter note, and (b) non-chord tone information AS-2 which includes two pieces of D2 note information AS-D2 representing the pitch of the note D2 and the time length of the eighth note. These pieces of information are arranged in the order (AS-G2)-(AS-D2)-(AS-C3)-(AS-G2')-(AS-D2)-(AS-C3').

WHERE CHORD TYPE IS DIMINISHED (dim)

In the case where the key-ON pattern KP is C3-E3♭ (=D3♯)-G3♭ (=F3♯)-A3 as shown in FIG. 4B, row 1, the component notes of the chord indicated by the pattern are C3, E3♭ (=D3♯), G3♭ (=F3♯) and A3 and consequently their pitch names are "C", "E♭ (=D♯)", "G♭ (=F♯)" and "A", the chord type is diminished (dim), the pitch name of the chord root is "C" and the pitch name of the chord bass is "C".

In this instance, the accompaniment pattern AS is composed of (a) a chord tone information AS-1 which includes (1) a piece of C2 note information AS-C2 representing the pitch of the note C2 and the time length of an eighth note, (2) a piece of E2♭ note information AS-E2♭ representing the pitch of the note E2♭ and the time length of the eighth note, (3) a piece of C2 note information AS-C2' representing the pitch of the note C2 and the time length of the quarter note and (4) a piece of E2♭ note information AS-E2♭ representing the pitch of the note E2♭ and the time length of the quarter note, and (b) non-chord tone information AS-2 which includes two pieces of D2 note information representing the pitch of the note D2 and the time length of the eighth note. These pieces of information are arranged in the order (AS-C2)-(AS-D2)-(AS-E2♭)-(AS-C2')-(AS-D2)-(AS-E2♭').

In the case where the key-ON pattern KP is E3♭ (=D3♯)-G3♭ (=F3♯)-A3-C4 as shown in FIG. 4A, row 4, the component notes of the chord indicated by the pattern are E3♭ (=D3♯), G3♭ (=F3♯), A3 and C4 and consequently their pitch names are "E♭ (=D♯)", "G♭ (=F♯)", "A" and "C", the chord type is diminished (dim), the pitch name of the chord root is "C" and the pitch name of the chord bass is "E♭ (=D♯)".

In this instance, the accompaniment pattern information AS is composed of (a) the chord tone information AS-1 which includes (1) a piece of E2♭ (=D2♯) note information AS-E2♭ (=D2♯) representing the pitch of the note E2♭ (=D2♯) and the time length of an eighth note, (2) a piece of G2♭ note information AS-G2♭ representing the pitch of the note G2♭ and the time length of the eighth note, (3) a piece of E2♭ (=D2♯) note information AS-E2♭' (=D2♯') representing the pitch of the note D2♭ (=D2♯) and the time length of a quarter note and (4) a piece of G2♭ note information AS-G2♭' representing the pitch of the note G2♭ and the time length of the quarter note, and (b) non-chord tone information AS-2 which includes two pieces of F2 note information AS-F2 representing the pitch of the note F2 and the time length of the eighth note. These pieces of information are arranged in the order (AS-E2♭ (=D2♯))-(AS-F2)-(AS-G2♭)-(AS-E2♭' (=D2♯'))-(AS-F2)-(AS-G2♭' (=F2♯')).

In the case where the key-ON pattern KP is G3♭ =F3♯)-A3-C4-E4♭ (=D4♯) as shown in FIG. 4B, row 7, the component tones of the chord indicated by the pattern are G3♭ (=F3♯), A3, C4 and E4♭ (= D4♯) and consequently their pitch names are "G♭ (=F♯)", "A", "C" and "E♭ (=D♯)", the chord type is diminished (dim), the pitch name of the chord root is "C" and the pitch name of the chord bass is "G♭ (=F♯)".

In this instance, the accompaniment pattern information AS is composed of (a) chord tone information AS-1 which is composed of (1) a piece of G2♭ (=F2♯) note information AS-G2♭ (=F2♯) representing the pitch of the note G2♭ (=F2♯) and the time length of an eighth note, (2) a piece of A2 note information AS-A2 representing the pitch of the note A2 and the time length of the eighth note, (3) a piece of G2♭ (=F2♯) note information AS-G2♭' (=F2♯') representing the pitch of the note G2♭ (=F2♯) and the time length of a quarter note and (4) a piece of A2 note information AS-A2' representing the pitch of the note A2 and the time length of the quarter note, and (b) non-chord tone information AS-2 which include two pieces of A2♭ note information AS-A2♭ (=G2♯) representing the pitch of the note A2♭ (=G2♯) and the time length of the eighth note. These pieces of information are arranged in the order (AS-G2♭ (=F2♯))-(AS-A2♭ (=G2♯))-(AS-A2)-(AS-G2♭' (=F2♯'))-(AS-A2♭ (=G2♯))-(AS-A2').

In the case where the key-ON pattern KP is A3-C4-E4♭ (=D4♯)-G4♭ (=F4♯) as shown in FIG. 4B, row 10, the component notes of the chord indicated by the pattern are A3, C4, E4♭ (=D4♯) and G4♭ (=F4♯) and consequently their pitch names are "A", "C", "E♭ (=D♯)" and "G♭ (=F♯)", the chord type is diminished (dim), the pitch name of the chord root is "C" and the pitch name of the chord bass is "A".

In this instance, the accompaniment pattern information AS is composed of (a) chord tone information AS-1 which includes (1) a piece of A2 note information AS-A2 representing the pitch of the note A2 and the time length of an eighth note, (2) a piece of C3 note information AS-C3 representing the pitch of the note C3 and the time length of the eighth note, (3) a piece of A2 note information AS-A2' representing the pitch of the note A2 and the time length of a quarter note and (4) a piece of C3 note information AS-C3' representing the pitch of the note C3 and the time length of the quarter note, and (b) non-chord tone information AS-2 which includes two pieces of B2 note information AS-B2 representing the pitch of the note B2 and the time length of the eighth note. These pieces of information are arranged in the order (AS-A2)-(AS-B2)-(AS-C3)-(AS-A2')-(AS-B2)-(AS-C3').

WHERE CHORD TYPE IS MINOR SEVENTH

In the case where the key-ON pattern KP is C3-E3♭ (=D3♯)-G3-B3♭ (=A3♯) as shown in FIG. 5A, row 1, the component notes of the chord indicated by the pattern are C3, E3♭ (=D3♯), G3 and B3♭ (=A3♯) and consequently their pitch names are "C", "E♭ (=D♯)", "G" and "B♭ (=A♯)", the chord type is minor seventh, the pitch name of the chord root is "C" and the pitch name of the chord bass is "C".

In this instance, the accompaniment pattern AS is composed of (a) chord tone information AS-1 which includes (1) a piece of C2 note information AS-C2 representing the pitch of the note C2 and the time length of an eighth note, (2) a piece of E2♭ (=D2♯) note information AS-E2♭ (=D2♯) representing the pitch of the note E2♭ (=D2♯) and the time length of the eighth note, (3) a piece of C2 note information AS-C2' representing the pitch of the note C2 and the time length of a quarter note and (4) a piece of E2♭ (=D2♯) note information AS-E2♭' (=D2♯') representing the pitch of the note E2♭ (=D2♯) and the time length of the quarter note, and (b) non-chord tone information AS-2 which includes two pieces of D2 note information AS-D2 representing the pitch of the note D2 and the time length of the eighth note. These pieces of information are arranged in the order (AS-C2)-(AS-D2)-(AS-E2♭ (=D2♯))-(AS-C2')-(AS-D2)-(AS-E2♭' (=D2♯')).

In the case where the key-ON pattern KP is D3-E3♭ (=D3♯)-G3-B3♭ (=A3♯) as shown in FIG. 5A, row 3, the component notes of the chord indicated by the patterns are D3, E3♭ (=D3♯), G3 and B3♭ (=A3♯) and consequently their pitch names are "D", "E♭ (=D♯)", "G" and "B♭ (=A♯)", the chord type is minor seventh, the pitch name of the chord root is "C" and the pitch name of the chord bass is "D".

In this instance, the accompaniment pattern information AS is composed of non-chord tone information AS-2 which includes four pieces of D2 note information AS-D2 representing the pitch of the note D2 and the time length of an eighth note and two pieces of D2 note information AS-D2' representing the pitch of the note D2 and the time length of a quarter note. Three of the pieces of D2 note information AS-D2, one of the pieces of D2 note information AS-D2', the remaining one piece of D2 note information AS-D2 and the other piece of AS-D2' are arranged in this order.

In the case where the key-ON pattern KP is E3♭ (=D3♯)-G3-B3♭ (=A3♯)-C4 as shown in FIG. 5A, row 4, the component notes of the chord indicated by the pattern are E3♭ (=D3♯), G3, B3♭ (=A3♯) and C4 and consequently their pitch names are "E♭ (=D♯)", "G", "B♭ (=A♯)" and "C", the chord type is minor seventh, the pitch name of the chord root is "C" and the pitch name of the chord bass is "E♭ (=D♯)".

In this instance, the accompaniment pattern AS is composed of (a) chord tone information AS-1 which includes (1) a piece of E2♭ (=D2♯) note information AS-E2♭ (=D2♯) representing the pitch of the note E2♭ (=D2♯) and the time length of an eighth note, (2) a piece of G2 note information AS-G2 representing the pitch of the note G2 and the time length of the eighth note, (3) a piece of E2♭ (=D2♯) note information AS-E2♭' (=D2♯') representing the pitch of the note E2♭ (=D2♯) and the time length of a quarter note and piece of G2 note information AS-G2' representing the pitch of the note G2 and the time length of the quarter note, and (b) non-chord tone information AS-2 which includes two pieces of F2 note information AS-F2 representing the note F2 and the time length of the eighth note. These pieces of information are arranged in the order (AS-E2♭ (=D2♯))-(AS-F2)-(AS-G2)-(AS-E2♭' (=D2♯'))-(AS-F2)-(AS-G2').

In the case where the key-ON pattern KP is G3-B3♭ (=A3♯)-C4-E4♭ (=D4♯) as shown in FIG. 5B, row 8, the component notes of the chord indicated by the pattern are G3, B3♭ (=A3♯), C4 and E4♭ (=D4♯) and consequently their pitch names are "G", "B♭ (=A♯)", "C" and "E♭ (=D♯), the chord type is minor seventh, the pitch name of the chord root is "C" and the pitch name of the chord bass is "G".

In this instance, the accompaniment pattern information AS is composed of (a) chord tone information AS-1 which includes (1) a piece of G2 note information AS-G2 representing the pitch of the note G2 and the time length of an eighth note, (2) a piece of B2♭ (=A2♯) note information AS-B2♭ (=A2♯) representing the pitch of the note B2♭ (=A2♯) and the time length of the eighth note, (3) a piece of G2 note information AS-G2' representing the pitch of the note G2 and the time length of a quarter note and (4) a piece of B2♭ (=A2♯) note information AS-B2♭' (=A2♯') representing the pitch of the note B2♭ (=A2♯) and the time length of the quarter note, and (b) non-chord tone information AS-2 which includes two pieces of D2 note information AS-D2 representing the pitch of the note D2 and the time length of the eighth note. These pieces of information are arranged in the order (AS-G2)-(AS-D2)-(AS-B2♭ (=A2♯))-(AS-G2')-(AS-D2)-(AS-B2♭' (=A2♯')).

In the case where the key-ON pattern KP is B3♭ (=A3♯)-C4-E4♭ (=D4♯)-G4 as shown in FIG. 5B, row 11, the component notes of the chord indicated by the pattern are B3♭ (=A3♯), C4, E4♭ (=D4♯) and G4 and consequently their pitch names are "B♭ (=A♯)", "C", "E♭ (=D♯)" and "G", the chord type is minor seventh, the pitch name of the chord root is "C" and the pitch name of the chord bass is "B♭ (=A♯)".

In this instance, the accompaniment pattern information AS is composed of (a) chord tone information AS-1 which includes (1) a piece of B2♭ (=A2♯) note information AS-B2♭ (=A2♯) representing the pitch of the note B2♭ (=A2♯) and the time length of an eighth note, (2) a piece of C3 note information AS-C3 representing the pitch of the note C3 and the time length of the eighth note, (3) a piece of B2♭ (=A2♯) note information AS-B2♭' (=A2♯') representing the pitch of the note B2♭ (=A2♯) and the time length of a quarter note and (4) a piece of C3 note information AS-C3' representing the pitch of the note C3 and the time length of the quarter note, and (b) non-chord tone information AS-2 which includes two pieces of D2 note information AS-D2 representing the pitch of the note D2 and the time length of the eighth note. These pieces of information are arranged in the order (AS-B2♭ (=A2♯))-(AS-D2)-(AS-C3)-(AS-B2♭' (=A2♯'))-(AS-D2)-(AS-C3').

ACCOMPANIMENT PATTERN INFORMATION AS

The accompaniment pattern information AS described above has such a structure that a pitch or pitches of a standard accompaniment pattern information SAS described on a pitch alteration table TB have been altered or not altered to other pitches described on the pitch alteration table TB. Standard Accompaniment Pattern Information SAS As shown in FIGS. 2A to 5B the standard accompaniment pattern information SAS has exactly the same construction as the afore-mentioned accompaniment pattern information AS, shown in FIG. 2A, row 2, which is available from the accompaniment pattern information generating means 4 when the key-ON pattern KP has the afore-mentioned pattern shown in FIG. 2A, row 1.

Accordingly, the standard accompaniment pattern information SAS is composed of (a) chord tone information AS-1 which includes (1) a piece of C2 note information AS-C2 representing the pitch of the note C2 and the time length of the eighth note, (2) a piece of E2 note information AS-E2 representing the pitch of the note E2 and the time length of the eighth note, (3) a piece of C2 note information AS-C2' representing the pitch of the note C2 and the time length of the quarter note and (4) a piece of E2 note information AS-E2' representing the pitch of the note E2 and the time length of the quarter note, and (b) two pieces of D2 note information AS-2 representing the pitch of the note D2 and the time length of the eighth note. These pieces of information are arranged in the order (AS-C2)-(AS-D2)-(AS-E2)-(AS-C2')-(AS-D2)-(AS-E2').

PITCH ALTERATION TABLE TB.

The pitch alteration table TB includes: four major (M) pitch alteration tables corresponding to key-ON patterns KP shown in FIG. 2A, rows 1, 3, and 5 and FIG. 2B, row 8, respectively; four minor (m) pitch alteration tables TB-m corresponding to key-ON patterns KP shown in FIG. 3A, rows 1, 3, and 4 and FIG. 3B, row 8, respectively: four diminish pitch alteration tables TB-dim corresponding to key-ON patterns KP shown in FIG. 4A, rows 1 and 4 and FIG. 4B, rows 7 and 10, respectively: and five minor-seventh pitch alteration tables TB-m7 corresponding to key-ON patterns KP shown in FIG. 5A, rows 1, 3 and 4 and FIG. 5B, rows 8 and 11, respectively.

These pitch alteration tables TB-M, TB-m, TB-dim and TB-m7 have the following descriptions.

In the following, pitches of notes "C2", C2♯ (=D2♭)", "D2", . . . "A♯ (=B♭)", "B2", "C3♯ (=D3♭)", . . . will be represented by decimal numbers "0", "1", "2", see Tables of FIG. 6.

MAJOR (M) PITCH ALTERATION TABLES TB-M

In the pitch alteration table TB-M corresponding to the key-ON pattern KP shown in FIG. 2A, row 1, there is described [None of all pitches "C2(=0)", "C2♯(=D2♭) (=1)", "D2(=2)", . . . in the standard accompaniment pattern SAS are altered to other pitches.] This is indicated by "C2(=0)N TC2(=2)N Not altered" in FIG. 2A, row 1.

In the pitch alteration table TB-M corresponding to the key-ON pattern KP shown in FIG. 2A, row 3, there is described [All Pitches "C2(=0)", "C2♯(=D2♭)", . . . , but except "D2", in the standard accompaniment pattern SAS are altered to pitch "DA(=2)".] This is indicated by "C2(=0)N (except D2 (=2)) T D2(=2)" in FIG. 2A, row 5.

In the pitch alteration table TB-M corresponding to the key-ON pattern KP shown in FIG. 2A, row 5, there is described [In standard accompaniment pattern information SAS; (1) pitch "C2(=0)" is altered to pitch "E2(=4)"; (2) pitch "E2(=4)" is altered to pitch "G2(=7)"; (3) pitch "G2(=7)" is altered to pitch "C3(12)"; and (4) all pitches "C2(=0)", "C2♯(=1)", but except "C2(=0)", "E2(=4)" and "G2(=7)", are not altered to other pitches.] This is indicated by "C2(=0)" T E2 (=4), "E2 (=4) T G2 (=7), G2 (=7) T C3 (=12), C2 (=0) N (except C2, E2, G2) T C2 (=0) N Not altered" in FIG. 2A, row 5.

In the pitch alteration table TB-M corresponding to the key-ON pattern KP shown in FIG. 2A, row 8, there is described [In standard accompaniment pattern information SAS: (1) pitch "C2 (=0)" is altered to pitch "G2 (=7)"; (2) pitch "E2 (=4)" is altered to pitch "C3 (=12)"; (3) pitch "G2 (=7)" is altered to pitch "E3 (=16)"; and (4) all pitches "C2 (=0)", "C2♯ (=1)", . . . , but except "C2 (=0)", "E2 (=4)" and "G2 (=7)", are not altered to other pitches.] This is indicated by "C2 (=0) T G2 (=7), E2 (=4) T C3 (=12), G3 (=7) T E3 (=16), C2 (=0) N (except C2, E2 and G2) T C2 (=0) N Not altered" in FIG. 2B, row 8.

MINOR (m) PITCH ALTERATION TABLE TB-m

In the pitch alteration table TB-m corresponding to the key-ON pattern KP shown in FIG. 3A, row 1, there is described [In Standard accompaniment pattern information SAS: (1) pitch "E2 (=4)" is altered to pitch "E2♭ (=D2#) (=1); and (2) all pitches "C2 (=0)", "C2# (=D2♭) (=1)", D2 (=2)", . . . , but except "E2 (=4)", are not altered to other pitches.] This is indicated by "E2 (=4) T E2♭ (=D2#) (=3), C2 (=0) N (except E2) T C2 (=0) N Not altered" in FIG. 3A, row 1.

In the pitch alteration table TB-m corresponding to the key-ON pattern KP shown in FIG. 3A, row 3, there is described [In standard accompaniment pattern information SAS: all pitches "C2 (=0)", "C2# (=D2♭)", (=2)".] This is indicated by "C2 (=0) N T D2 (=2)" in FIG. 3A, row 3.

In the pitch alteration table TB-m corresponding to the key-ON pattern KP shown in FIG. 3A, row 4, there is described [In standard accompaniment pattern information SAS: (1) pitch "C2 (=0)" is altered to pitch "E2♭ (=D2#) (=3)"; (2) pitch "E2 (=4)" is altered to pitch "G2 (=7)"; (3) pitch "G2 (=7)" is altered to pitch "C3 (=12)"; and (4) all pitches "C2 (=0)", "C2# (=1)", . . . , but except "C2 (=0)", "E2 (=4)" and G2 (=7)", are not altered to other pitches.] This is indicated by "C2 (=0) T E2♭ (=D2#) (=3), E2 (=4) T G2 (=7), G2 (=7) T C3 (=12), C2 (=0)N (except C2, E2 and G2) TC2 (=0) N Not altered" in FIG. 3A, row 4.

In the pitch alteration table TB-m corresponding to the key-ON pattern shown in FIG. 3B, row 8, there is described [In standard accompaniment pattern information: (1) pitch "C2 (=0)" is altered to pitch "G2 (=7)"; (2) pitch "E2 (=4)" is altered to pitch "C3 (=12)"; (3) pitch "G2 (=7)" is altered to pitch "E3♭ (=D3#) (=15)"; and (4) all pitches "C2 (=0)", "C2 (=1)", are not altered to other pitches.] This is indicated by "C2 (=0) TC3 (=12), G2 (=7) T E3♭ (=D3#) (=15), C2 (=0) N (except C2, E2 and G2) T C2 (=0)N Not altered" in FIG. 3B, row 8.

DIMINISHED (dim) PITCH ALTERATION TABLE TB-dim

In the pitch alteration table TB-dim corresponding to the Key-ON pattern KP shown in FIG. 4A, row 1, there is described [In standard accompaniment pattern information SAS: (1) pitch "E2 (=4)" is altered to pitch "E2♭ (=D2#) (=3)"; (2) pitch G2 (=7) is altered to pitch "G2♭ (=F2#) (=6); and (3) all pitches "C2(=0)", "C2#(=D2♭)(=1)", "D2(=2)", . . . , but except "E2(=4)" and "G2(=7)", are not altered to other pitches]. This is indicated by "E2(=4) T E2♭ (=D2#)(=3), G2(=7) T G2♭ (=F2#)(=6), C2(=0) N (except E2 and G2) T C2(=0) N Not altered" in FIG. 4A, row 1.

In the pitch alteration table TR-dim corresponding to the key-ON pattern KP shown in FIG. 4A, row 4, there is described [In standard accompaniment pattern information SAS: (1) pitch "E2 (=4)" is altered to pitch "G2♭ (=F2#) (=6)"; (2) pitch "G2 (=7)" is altered to pitch "A2 (=9)"; and (3) all pitches "C2(=0)", "C2#(=D2♭), . . . , but except "E2(=4)" and "G2(=7)", are altered to pitches higher than them by "3" in decimal.] This is indicated by "E2(=4) T G2♭ (=F2#) (=6), G2 (=7) T A2 (=9), C2 (=0) N (except E2 and G2) T E2♭ (=D2#) (=3) N" in FIG. 4A, row 4.

In the pitch alteration table TB-dim corresponding to the key-ON pattern KP shown in FIG. 4B, row 7, there is described [In standard accompaniment pattern information SAS: (1) pitch "E2 (=4)" is altered to pitch "A2 (=9)"; (2) pitch "G2 (=7) is altered to pitch "C3 (=12)"; and (3) all pitches "C2(=0)", "C2#(=D2♭)", . . . , but except "E2(=4)" and "G2(=7)", are altered to pitches higher than them by "6" in decimal.] This is indicated by "E2(=4) T A2(=9), G2(=7) T C3 (=12), C2(=0) N (except E2 and G2) T G2♭(F2#)(=6) N" in FIG. 4B, row 7.

In the pitch alteration table TB-dim corresponding to the key-ON pattern KP shown in FIG. 4B, row 10, there is described [In standard accompaniment pattern information SAS: (1) pitch "E2(=4)" is altered to pitch "C3(=12)"; (2) pitch "G2(=7)" is altered to pitch "E3♭(=D3#) (=15); and (3) all pitches "C2(=0)", "C2#(=D2♭)", pitches higher than them by "9" in decimal.] This is indicated by "E3(=4) T C3(=12), G2(=7) T E3♭ (=D3#) (=15), C2(=0) N (except E2 and G2) T A2(=9) N" in FIG. 4B, row 10.

MINOR SEVENTH (m7) PITCH ALTERATION TABLES TB-m7

In the pitch alteration table TB-m7 corresponding to the key-ON pattern KP shown in FIG. 5A, row 1, there is described [In standard accompaniment pattern information SAS: (1) pitch "E2(=4)" is altered to pitch "D2# (=E2♭) (=4)"; (2) pitch "B2 (=11)" is altered to pitch "A2#(=B2♭)(=10)"; and (3) all pitches "C2(=0)", "C2#(=1)", . . . , but except "E2(=4)" and "B2(=11)", are not altered to other pitches.] This is indicated by "E2(=4) T E2♭(=D2#)(=3), B2(=11) T B2♭ (=A2#)(=10), C2(=0) N (except E2 and B2) T C2(=0) N Not altered" in FIG. 5A, row 1.

In the pitch alteration table TB-m7 corresponding to the key-ON pattern KP shown in FIG. 5A, row 3, there is described [In standard accompaniment pattern information SAS, all pitches "C2(=0)", "C2#(=D2♭), (=2)".] This is indicated by "C2(=0) N T D2(=2)" in FIG. 5A, row 3.

In the pitch alteration table TB-m7 corresponding to the key-ON pattern KP shown in FIG. 5A, row 4, there is described [In standard accompaniment pattern information SAS, all pitches "C2 (=0)", "C2#(=D2♭)(=1)", "D2(=2)", . . . are altered to pitches higher than them by "3" in decimal.] This is indicated by "C2(=0) N T D2# (=E2♭) (=3)" in FIG. 5A, row 4.

In the pitch alteration Table TB-m7 corresponding to the key-ON pattern KP shown in FIG. 5B, row 8, there is described [In standard accompaniment pattern information SAS: (1) pitch "C2(=0)" is altered to pitch "G2(=7)"; (2) pitch "E"(=4)" is altered to pitch "A2#(=B2♭)(=10)"; (3) pitch "G2(=7)" is altered to pitch "C3(=12)"; (4) pitch "B2(=11)" is altered to pitch "D3#(=E3♭)(=15)"; and (5) all pitches "C2(=0)", "C2#(=1)", but except "C2(=0)", "E2(=4)", "G2(=7)" and "B2(=11)", are not altered to other pitches.] This is indicated by "C2(=0) T G2(=7), E2(=4) T B2♭(=A2#) (=10), G2(=7) T C3(=12), B2(=11) T D3#(=E3♭)(=15), C2(=0) N (except C2, E2, G2 and B2) T C2(=0) N Not altered" in FIG. 5B, row 8.

In this pitch alteration table TB-m7 corresponding to the key-ON pattern KP shown in FIG. 5B, row 11, there is described [In standard accompaniment pattern information SAS: (1) pitch "C2 (=0)" is altered to pitch "B2♭ (=A2♯) (=10)"; (2) pitch E2 (=4) is altered to pitch "C3 (=12)"; (3) pitch "G2(=7)" is altered to pitch "E3♭ (=D3♯) (=15)"; (4) pitch "B2(=11)" is altered to pitch "G3(=19)"; and (5) all pitches "C2(=0)", "C2♯(=1)", . . . , but except "C2(=0)", "E2(=4)", "G2(=7)" and "B2(=11)", are not altered to other pitches.] This is indicated by "C2(=0) T B2♭(=A2♯)(=10), E2(=4) T C3(=12), G2(=7) T E3♭(=D3♯)(=15), B2(=11) T G3(=19), C2(=0) N (except C2, E2, G2 and B2) T C2(=0) N Not altered" in FIG. 5B, row 8.

ACCOMPANIMENT PATTERN NOTE GENERATING MEANS

The automatic accompaniment device of the present invention, illustrated in FIG. 1, further includes accompaniment pattern note generating means 5 for generating the accompaniment pattern note SS, as is the case with the conventional automatic accompaniment device.

The accompaniment pattern note generating means 5 has tone generators (not shown) for generating notes of the pitches and time lengths represented by plurality of pieces of note information forming the accompaniment pattern information AS (such as C2 note information AS-C2, E2 note information AS-E2, etc.) and, by the tone generators, generates accompaniment pattern notes based on accompaniment patterns represented by the accompaniment pattern information AS available from the accompaniment pattern information generating means 4.

The generation of the accompaniment pattern note SS by the accompaniment pattern note generating means 5 is also performed through the aid of a computer.

OPERATIONAL EFFECT OF EMBODIMENT 1

As is the case with the prior art, according to the FIG. 1 embodiment of the present invention, once the key-ON pattern information KS is generated by obtaining, from the key-ON pattern information generating means 1, the key-ON pattern KP as a pattern representing a chord o the keyboard 111 of the key-ON information generating circuit 11, the accompaniment pattern information AS corresponding to the key-ON pattern KP is automatically provided from the accompaniment pattern information generating means 4 and then the accompaniment pattern note SS based on the accompaniment pattern represented by the accompaniment pattern information AS is generated by the accompaniment pattern note generating means 5.

Further, as in the case of the conventional device, according to the automatic accompaniment device of the present invention depicted in FIG. 1, since the accompaniment pattern information AS available from the accompaniment pattern information generating means 5 is composed of the chord tone information AS-1 representing a tone which has the pitch name of a tone constituting the chord indicated by the key-ON pattern KP and non-chord-tone information AS-2 representing a non chord tone which has the pitch name of a tone other than that of the chord tone, and since these pieces of information AS-1 and AS-2 are arranged in the time series corresponding to the rhythm represented by the rhythm information available from the automatic rhythm device and in the order corresponding to the type of the chord represented by the key-ON pattern KP and the pitch name of the chord root, the accompaniment pattern tone SS is richer in sound than in the case where the accompaniment pattern information AS is composed only of the chord tone information AS-1.

With the automatic accompaniment device of the present invention described above with respect to FIG. 1, however, the accompaniment pattern information AS is obtained from the accompaniment pattern information generating means 4, based on the chord type information CS, the chord root information RS and chord bass information LS.

On this account, even if the chord represented by the key-ON pattern information KPS remains unchanged in both of the chord type and the chord root, but if the pitch name of the lowest note of the chord changes, the accompaniment pattern information AS changes accordingly.

In this instance, the chord tone information AS-1 differs, in the pitch name of the chord tone, with the pitch name of the lowest note of the chord represented by the key-ON pattern KP but the non-chord-tone information remains unchanged, as shown in FIG. 2A, rows 1 and 5, and FIG. 2B, row 8 in the case where the chord type is major (M), in FIG. 3A, rows 1 and 4, and FIG. 3B, row 8 in the case where the chord type is minor (m) and in FIG. 5A, rows 1, 3 and 4, and FIG. 3B, rows 8 and 11 in the case where the chord type is minor seventh (m7).

Thus, according to the FIG. 1 embodiment of the present invention, the accompaniment pattern information AS can be obtained as information which makes it possible to generate an accompaniment pattern note richer in sound than in the prior art.

PROCESSING BY A DEVICE USING A MICROCOMPUTER

Next, it will be described that the above-described operational results by the FIG. 1 embodiment of the invention are obtained by performing predetermined processing with a device employing a microcomputer.

DEVICE USING A MICROCOMPUTER

A description will be given first, with reference to FIG. 7, of an embodiment of the device employing a microcomputer for the automatic accompaniment device of the present invention.

A device employing the microcomputer, which forms the automatic accompaniment device of the invention, has the following construction.

That is, the device includes a CPU 90 forming a known microcomputer.

Connected to the CPU 90 via bus line 91 are the key-ON information generating circuit 11 having the keyboard 111, shown in FIG. 1, a tempo clock pulse generating circuit 92, a program memory circuit 93, a control circuit 94, a tempo clock pulse count register 95, a standard accompaniment pattern information memory circuit 96, a pitch alteration table memory circuit 97, a tone source circuit 98, a key-ON pattern information register 101, a chord type information register 102, a chord root information register 103, a chord bass information register 104, a selected pitch alteration table memory circuit 105, a shifted amount information register 106 and a pitch-ON/OFF data register 107.

KEY-ON INFORMATION GENERATING CIRCUIT 11

The key-ON information generating circuit 11 generates the key-ON information KS described previously in respect of FIG. 1.

TEMPO CLOCK PULSE GENERATING CIRCUIT 92

The tempo clock pulse generating circuit 92 is connected to the CPU 90 via the bus line 91 and an interrupt line 91' as well.

The tempo clock pulse generating circuit 92 generates a tempo clock pulse TCP which determines the tempo of the accompaniment pattern note SS which is provided by the accompaniment pattern note generating means 5 referred to previously with respect to FIG. 1.

The tempo clock pulse TCP has a period of, for example, 1/400 of the 4-beat period of the accompaniment pattern note SS, since the accompaniment pattern note SS has a structure in which four eighth notes and two quarter notes are sequentially arranged. The time which determines the period of the tempo clock pulse TCP is determined by the rhythm represented by the rhythm information available from the automatic rhythm device used in combination with the accompaniment device of the present invention.

PROGRAM MEMORY CIRCUIT 93

Figure 8:
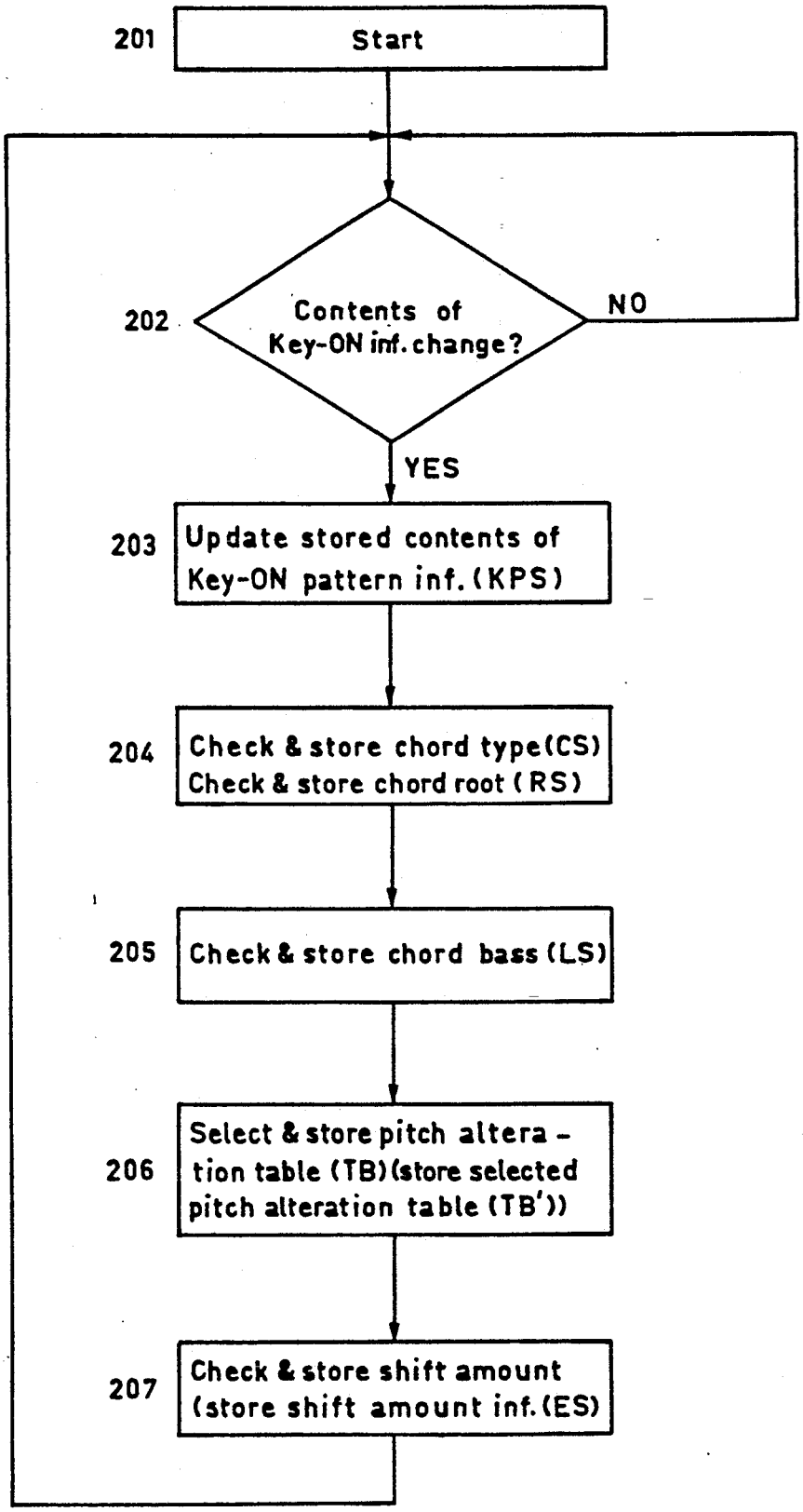
FIGS. 8 and 9 are flow charts relating to the device of FIG. 7.
Figure 9:
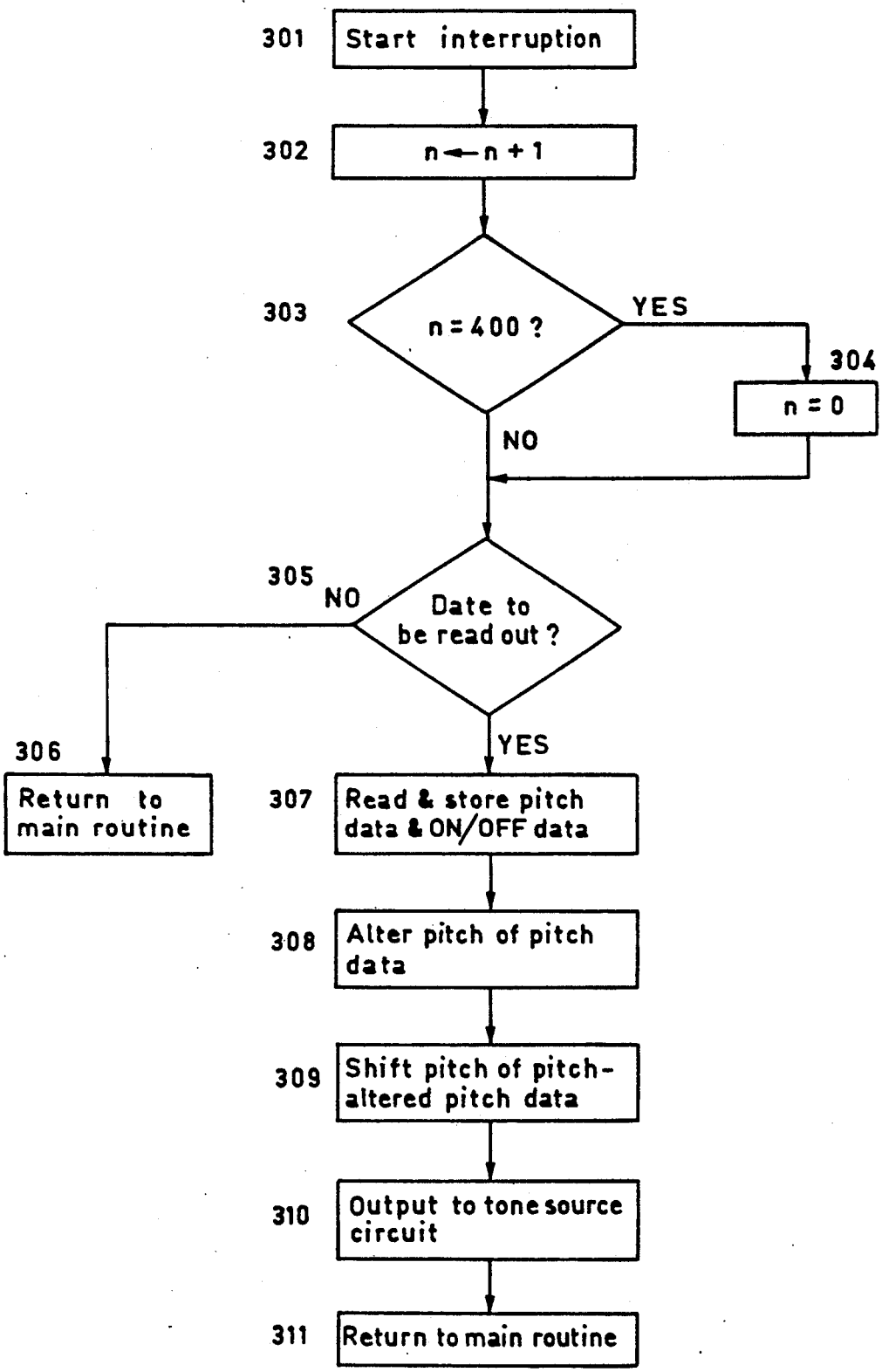

The program memory circuit 93 has a construction in which a main routine program 931 for causing the CPU 90 to perform processing following a main routine described later with respect to FIG. 8 and an interrupt routine program 932 for causing the CPU 90 to perform processing following an interrupt routine described later in respect of FIG. 9 are stored in a random access memory.

CONTROL CIRCUIT 94

The control circuit 94 has a start switch 941 for starting the operation of the device, a stop switch 942 for stopping the operation of the device, etc.

TEMPO CLOCK PULSE COUNT REGISTER 95

The tempo clock pulse count register 95 stores the count output of the tempo clock pulse TCP from the tempo clock pulse generating circuit 92.

KEY-ON PATTERN INFORMATION REGISTER 101

The key-ON pattern information register 101 stores the key-ON pattern information KPS available from the key-ON pattern information generating means 1 described previously in respect of FIG. 1. If the contents of the key-ON information KS from the key-ON information generating circuit 11 changes, then the key-ON pattern information KPS is stored in the form that it has been updated accordingly.

CHORD TYPE INFORMATION REGISTER 102

The chord type information register 102 stores the chord type information CS generated by the chord type information generating means 2 described previously with respect to FIG. 1.

CHORD ROOT INFORMATION REGISTER 103

The chord root information register 102 stores the chord root information RS generated by the chord root information generating means 3 referred to previously with respect to FIG. 1.

CHORD BASS INFORMATION REGISTER 104

The chord bass information register 104 stores the chord bass information RS generated by the chord bass information generating means 6 described previously in respect of FIG. 1.

STANDARD ACCOMPANIMENT PATTERN INFORMATION MEMORY CIRCUIT 96

In the standard accompaniment pattern information memory circuit 96 there is stored the standard accompaniment pattern information SAS desribed previously in respect of FIGS. 2A to 5B.

As referred to previoulsy, the standard accompaniment pattern information SAS has such a structure that (1) C2 note information AS-C2 representing the pitch of the note C2 and the time length of the eighth note, (2) D2 note information AS-D2 representing the pitch of the note D2 and the time length of the eighth note, (3) E2 note information AS-E2 representing the pitch of the note E2 and the time length of the eighth note, (4) C2 note information AS-C2' representing the pitch of the note E2 and the time length of the quarter note, (5) D2 note information AS-D2 representing the pitch of the note D2 and the time length of the eighth note, and (6) E2 note information AS-E2' representing the pitch of the note E2 and time length of the quarter note are arranged in this order.

These pieces of information AS-C2, AS-D2-1, AS-E2, AS-C2', AS-D2 and AS-C2' are stored in the standard accompaniment pattern information memory circuit 96 in the following manner:

Now, let sequential time points when the tempo clock pulses TCP are sequentially produced by the tempo clock pulse generating circuit 92 be represented by decimal numbers "0", "1", "2", "3", . . . . The first C2 note information AS-C2 forming the standard accompaniment pattern information SAS is stored as a combination of (1) tone generating data which composed of clock data indicating time "0", pitch data indicating pitch C2 (=0) and "ON" data indicating tone generation, and (2) tone stopping data which is composed of clock data indicating time "48", pitch data indicating pitch C2 and "OFF" data indicating the stop of tone generation, as shown in FIG. 10, row 1.

The second D2 note information AS-D2 is stored as a combination of (1) tone generating data which is composed of clock data indicating time "50", pitch data indicating pitch D2 (=2) and "ON" data indicating tone generation, and (2) tone stopping data which is composed of clock data indicating time "98", pitch data D2 (=2) and "OFF" data indicating the stop of tone generation, as shown in FIG. 10, row 2.

The third E2 note information AS-E2 forming the standard accompaniment pattern information SAS is stored as a combination of (1) tone generating data which is composed of clock data indicating time "100", pitch data indicating pitch E2 (=4) and "ON" data indicating tone generation, and (2) tone stopping data which is composed of clock data indicating time "148", pitch data indicating pitch E2 (=4) and "OFF" data indicating the stop of tone generation, as shown in FIG. 10, row 3.

The fourth C2 note information AS-C2' is stored as a combination of (1) tone generating data which is composed of clock data indicating time "150", pitch data indicating pitch C2 (=0) and "ON" data indicating tone generation, and (2) tone stopping data which is composed of clock data indicating time "248", pitch data C2 (=0) and "OFF" data indicating the stop of tone generation, as shown in FIG. 10, row 4.

The fifth D2 note information AS-D2 forming the standard accompaniment pattern information SAS is stored as a combination of (1) tone generating data which is composed of clock data indicating time "250", pitch data indicating pitch D2 (=2) and "ON" data indicating tone generation, and (2) tone stopping data which is composed of clock data indicating time "298", pitch data indicating pitch D2 (=0) and "OFF" data indicating the stop of tone generation, as shown in FIG. 10, row 5.

The sixth C2 information AS-C2' is stored as a combination of (1) tone generating data which is composed of clock data indicating time "300", pitch data indicating pitch C2 (=0) and "ON" data indicating tone generation, and (2) tone stopping data which is composed of clock data indicating time "398", pitch data C2 (=0) and "OFF" data indicating the stop of tone generation, as shown in FIG. 10, row 6.

PITCH ALTERATION TABLE MEMORY CIRCUIT 97

In the pitch alteration table memory circuit 97 there are stored such pitch alteration tables TB as the major pitch alteration tables TB-M shown in FIG. 2A, rows 1, 3 and 5, and FIG. 2B row 8, the minor pitch alteration tables TB-m shown in FIG. 3A, rows 1, 3, and 4, and FIG. 4B, row 8 diminished pitch alteration tables TB-dim shown in FIG. 4, rows 1, 4, 7 and 10 and the minor seventh pitch alteration tables TB-m7 shown in FIG. 5A, rows 1, 3 and 4, and FIG. 5B, rows 8 and 11.

SELECTED PITCH ALTERATION TABLE REGISTER 105

The selected pitch alteration table register 105 stores, as selected pitch alteration table TB', a selected one of the pitch alteration table TB stored in the pitch alteration table memory circuit 97. The selected pitch alteration table TB' is selected in the manner described later on in connection with step 206 of the main routine, based on the chord type information CS stored in the chord type information register 102, the chord root information RS stored in the chord root information register 103 and the chord bass information LS stored in the chord bass information register 104.

SHIFT AMOUNT INFORMATION REGISTER 106

The shift amount information register 106 stores, in a decimal form, the shift amount information ES produced using the chord root information RS stored in the chord root information register 103. The shift amount information ES is indicative of a shift amount corresponding to the difference in pitch between the pitch name of the chord root represented by the chord root information RS and the pitch name of the note "C".

PITCH-ON/OFF DATA REGISTER 107

The pitch-ON/OFF data register 107 stores pitch data and ON/OFF data which form the tone generating data of the standard accompaniment pattern information SAS described with respect to FIG. 10 and are read out of the standard accompaniment pattern information memory circuit 96 when the count value of the tempo clock pulse count register 95 is a predetermined decimal value. Then, the register 107 stores, in place of the prestored pitch data and ON/OFF data of the tone generating data, the pitch data and ON/OFF data of the tone generation stopping data which are read out of the memory circuit 96 when the count value of the tempo clock pulse count register 95 reaches another predetermined decimal value.

TONE SOURCE CIRCUIT 98

The tone source circuit 98 receives pitch data and ON/OFF data which is read out of the pitch and ON/-OFF data register 107 each time the register 107 stores the pitch data and the ON/OFF data read out of the standard accompaniment pattern information memory circuit 96. When the pitch data received by the tone source circuit 98 is indicative of a predetermined pitch, its pitch has been altered, based on the description of the selected pitch alteration table TB' stored in the selected pitch alteration table register 105, and has been shifted by the pitch difference which is represented by the shift amount information ES stored in the shift amount information register 106. When supplied with the tone generating data, the tone source circuit 98 generates a note of the pitch indicated by the pitch data forming the tone generating data, since the content of its ON/OFF data is "ON". Then, when supplied with the tone stopping data, the tone source circuit 98 stops the generation of the note of the pitch indicated by the pitch data included in the tone generating data, since the content of the ON/OFF data forming the tone stopping data is "OFF".

FLOW OF PROCESSING BY THE DEVICE USING THE MICROCOMPUTER

Next, a description will be given of predetermined processing by the device using the microcomputer for obtaining the operational effects described above.

Figure 7:
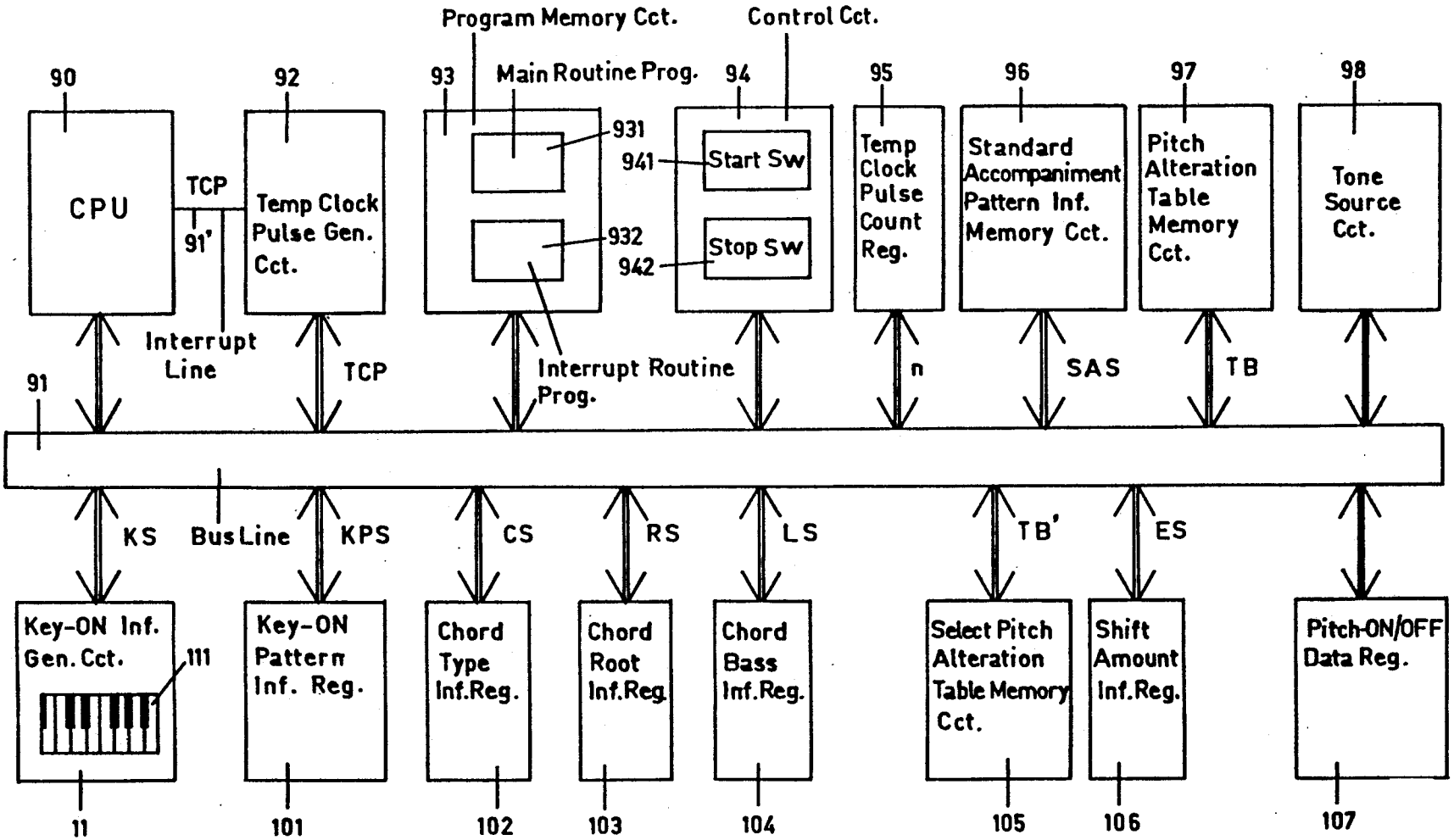
FIG. 7 is an embodiment showing the use of a microcomputer.

The predetermined processing by the device using the microcomputer shown in FIG. 7 is one that processing by an interrupt routine following the interrupt program 932 stored in the program memory 93 interrupts into processing by a main routine following the main routine program 931 stored in program memory 93.

FLOW OF PROCESSING BY MAIN ROUTINE

A description will be given first of the flow of processing by the main routine following the main routine execution program 931 stored in the program memory circuit 93. The main routine has steps 201 to 207 shown in FIG. 8.

STEP 201

Based on the "ON" operation of the start switch 941 in the control circuit 94, the CPU 90 starts the execution of the main routine following the main routine execution program 931 stored in the program memory circuit 94 and performs various initializations necessary for the execution of the main routine. Then, the process proceeds to step 202.

STEP 202.

The CPU 90 makes a check for a change in the contents of the key-ON information KS from the key-ON information generating circuit 11 and, if no change is detected, makes the check again. If a change is detected in the contents of the key-ON information KS, the process proceeds to step 203.

STEP 203

Based on the detection of the change in the contents of the key-ON information KS in step 202, the CPU 90 updates the key-ON information KP stored in the key-ON pattern information register 101, after which the process proceeds to step 204.

STEP 204

Based on the key-ON pattern information KPS stored in the key-ON pattern information register 101 and updated in step 203, the CPU 30 (1) checks the type of the chord represented by the key-ON pattern information KPS and stores the chord type information CS indicating the chord type in the chord type information register 102, and (2) checks the pitch name of root note of the chord represented by the key-ON pattern information KPS and stores the chord root information RS indicating the pitch name of the root note in the chord root information register 103. This technique is known from Japanese Patent Public Disclosure No. 196593/83. Then, the process proceeds to step 205.

STEP 205

Based on the key-ON pattern information KPS stored in the key-ON pattern information register 101, the CPU 90 checks the pitch name of the lowest note of the chord represented by the key-ON pattern information KPS and stores the chord bass information LS indicating the pitch name of the lowest note in the chord bass information register 104. Then, the process proceeds to step 206.

STEP 206

Based on the chord type information CS and the chord root information RS stored in the chord type information register 102 and the chord root information register 103 in step 204 and the chord bass information LS stored in the chord bass information register 104 in step 205, the CPU 90 selects, from many pitch alteration tables TB such as the afore-mentioned major pitch alteration tables TB-M, minor pitch alteration tables TB-m, diminished pitch alteration tables TB-dim and minor seventh pitch alteration tables TB-m7, one pitch alteration table predetermined by a combination of the chord type represented by the chord type information CS, the pitch name of the chord root represented by the chord root information RS and the pitch name of the chord bass represented by the chord bass information LS. The selected pitch alteration table is stored, as a selected pitch alteration table TB', in a selected pitch alteration table register 105. Then the process proceeds to step 207.

The actual selection of one of the pitch alteration tables TB in step 206 is made using root/bass difference information DS which represents the pitch difference between the pitch name of the chord root and the pitch name of the chord bass and the chord type information CS stored in the chord type information register 102. The root/bass difference information DS is obtained using the chord root information RS stored in the chord root information register 103 and the chord bass information LS stored in the chord bass information register 104.

In this instance, sequentially rising pitches "C", "C# (=D♭)", "D", . . . of pitches names of the chord root and bass are represented by decimal numbers "0", "1", "2", . . . in the same manner as in the case of the aforementioned pitch alteration table TB shown in FIG. 6 in which the pitches "C2", C2# (=D2♭)", "D2", . . . are shown to correspond to decimal numbers "0", "1", "2", of the chord root and the chord bass, represented by the root/bass difference information DS, is expressed in decimal.

For instance, in the case where the chord type represented by the chord type information CS is major (M), the aforementioned major pitch alteration table TB-M shown in FIG. 2A, rows 1, 3, or 5 or FIG. 2B, row 8 is selected as the selected major pitch alteration table TB'-M, if the pitch difference between the pitch names of the chord root and the chord bass represented by the root/bass difference information DS is "0", "2", "4", or "7" in decimal.

In the case where the chord type represented by the chord type information CS is minor (m), the afore-mentioned minor pitch alteration table TB-m shown in FIG. 3A, rows 1, 3 or 4, or FIG. 3B, row 8 is selected as the selected minor pitch alteration table TB'-m, if the pitch difference between the pitch names of the chord root and the chord bass represented by the root/bass difference information DS is "0", "2", "3", or "7" in decimal.

In the case where the chord type represented by the chord type information CS is diminished (dim), the afore-mentioned diminished pitch alteration table TB-dim shown in FIG. 4A, rows 1 or 4, or FIG. 4B, row 7 or 10 is selected as the selected diminished pitch alteration table TB'-dim, if the pitch difference between the pitch names of the chord root and the chord bass represented by the root/bass difference information DS is "0", "3", "6", or "9" in decimal.

In the case where the chord type represented by the chord type information CS is minor seventh (m7), the afore-mentioned minor seventh pitch alteration table TB-m7 shown in FIG. 5A, rows 1, 3, or 4 or FIG. 5B rows 8 or 11 is selected as the selected minor seventh pitch alteration table TB'-m7, if the pitch difference between the pitch names of the chord root and the chord bass represented by the root/bass difference information DS is "0", "2", "3", "7", or "10" in decimal.

STEP 207

Based on the chord root information RS stored in the chord root information register 103 in step 204, the CPU 90 obtains shift amount information ES representing a shift amount which is the pitch difference between the pitch name of the chord root indicated by the chord root information RS and the pitch name of the note "C". The shift amount information ES thus obtained is stored in a shift amount information register 106 and then the routine returns to step 202.

In this instance, the pitch difference between the pitch name of the chord root and the pitch name of the note "C", which is the shift amount represented by the shift amount information ES, is represented in decimal as is the case with the pitch difference between the pitch names of the chord root and the chord bass indicated by the root/bass information DS.

That is, in the case where the pitch name of the root note of the chord represented by the chord root information RS is "C" as shown in FIGS. 2A through 5B, the pitch name "C" is expressed as "0" in decimal; hence, the pitch difference between the pitch name of the root note of the chord which is the shift amount represented by the shift amount information ES and the pitch name "C" is also expressed as "0 (=0-0)". Further, in the case where the pitch name of the root note of the chord represented by the chord root information RS is "C# (=D♭)", "D", "D# (=E♭)", though not shown in FIGS. 2 to 5, the pitch names are expressed as "1", "2", "3", mentioned pitch differences are expressed as "1 (=1-0)", "2 (=2-0)", "3 (=3-0)", . . . in decimal, respectively.

FLOW OF PROCESSING BY INTERRUPT ROUTINE

Next, description will be given, with reference to FIG. 9, of the flow of processing by the interruption routine following the interrupt routine execution program 932 stored in the program memory circuit 93. The interrupt routine includes steps 301 through 311.

STEP 301

The CPU 90 starts handling of the interruption routine which interrupts in the above-mentioned main routine by inputting, as an interruption signal, the tempo clock pulse TCP from the tempo clock pulse generating circuit 92 via the interruption line 91'. Then the routine proceeds to step 302.

STEP 302

Upon each application thereto of the tempo clock pulse TCP, the CPU 90 increments the count value "n" of the tempo clock pulse count register 95 to "n+1" in decimal. Then the routine proceeds to step 303.

STEP 303

Upon each application thereto of the tempo clock pulse TCP, the CPU 90 makes a check to see if the count value of the tempo clock pulse count register 95 is a predetermined value "400" in decimal, and if so, the routine proceeds to step 304, whereas if not, then the routine proceeds to step 305.

The predetermined value "400" corresponds to the time length (of a bar) from the beginning to the end of the standard accompaniment pattern information SAS shown in FIGS. 2A to 5B.

STEP 304

The CPU 90 resets the count value "n" of the tempo clock pulse count register 95 to "0" decimal. Then the routine proceeds to step 305.

STEP 305

When the count value of the tempo clock pulse count register 95 is "0", "1", "2", . . . in decimal, the CPU 90 makes a check to see if the clock data indicating time "0", "1", "2", . . . is contained in the tone generating data and the tone stopping data of (1) the C2 note information AS-C2, (2) the D2 note information AS-D2, (3) the E2 note information AS-E2, (4) the C2 note information AS-C2', (5) the D2 note information AS-D2 and (6) the E2 note information AS-E2' which form the standard accompaniment pattern information SAS stored in the memory circuit 96. This is done by checking whether or not data to be read out is present in the standard accompaniment pattern information SAS. If no data is found to be read out, then the routine proceeds to step 306, and if data to be read out is found, the routine proceeds to step 307.

That is, in the standard accompaniment pattern information memory circuit 96, (1) the C2 note information AS-C2 (which has the time length of an eighth note and consequently the time length corresponding to "50" in decimal) is stored as a combination of the tone generating data including clock data which indicates time "0" and the tone stopping data including clock data which indicates time "48", as shown in FIG. 10, row 1, (2) the D2 note information SA-D2 (which has the time length of an eighth note and consequently the time length corresponding to "50" in decimal) is stored as a combination of the tone generating data including clock data which indicates time "50" and the tone stopping data including clock data which indicates time "98", as shown in FIG. 10, row 2, (3) the E2 note information AS-E2 (which has the time length of an eighth note and consequently the time length corresponding to "50" in decimal) is stored as a combination of the tone generating data including clock data which indicates time "100" and the tone stopping data including clock data which indicates time "100" and the tone stopping data including clock data which indicates time "148", as shown in FIG. 10, row 3, (4) the C2 note information AS-C2' (which has the time length of a quarter note and consequently the time length corresponding to "50" in decimal) is stored as a combination of the tone generating data including clock data which indicates time "150" and the tone stopping data including clock data which indicates time "248", as shown in FIG. 10, row 4, (5) the other D2 note information AS-D2 (which has the time length of an eighth note and consequently the time length corresponding to "50" in decimal) is stored as a combination of the tone generating data including clock data which indicates "250" and the tone stopping data including clock data which indicates time "298", as shown in FIG. 10, row 5, and (6) the E2 note information AS-E2' (which has the time length of a quarter note and consequently the time length corresponding to "50" in decimal) is stored as a combination of the tone generating data including clock data which indicates time "300" and the tone stopping data including clock data which indicates time "398", as shown in FIG. 10, row 6.

Thus, when the count contents of the tempo clock pulse count register 95 are (1) "0" and "48", (2) "50" and "98", (3) "100" and "148", (4) "150" and "248", (5) "250" and "298" and (6) "300" and "398", the CPU 90 decides that data to be read out is present in the standard accompaniment pattern information SAS, and the routine proceeds to step 307. However, when the count contents of the tempo clock pulse count register 95 are not the value mentioned just above, the CPU 90 decides that no data is to be read out, and the routine proceeds to step 306.

STEP 306

Each time it is determined in step 305 that no data to be read out is present in the standard accompaniment pattern information SAS, the interruption routine goes back to the main routine.

STEP 307

Each time it is determined in step 305 that data to be read out is present in the standard accompaniment pattern information SAS, the pitch data and the ON/OFF data included in the tone generating data or tone stopping data of the tone information AS forming the standard accompaniment pattern information SAS at that time are read out of the standard accompaniment pattern information memory circuit 96 and are stored in a pitch-ON/OFF data register 107. Then the routine proceeds to step 308.

Now, a description will be given of the read out of the pitch data and the ON/OFF data from the standard accompaniment pattern information memory 96 and their storage in the pitch-ON/OFF data register 107.

As mentioned above, when the contents of the tempo clock pulse count register 95 are (1) "0" and "48", (2) "50" and "98", (3) "100" and "148", (4) "150" and "248", (5) "250" and "298" and (6) "300" and "398" in decimal, the CPU 90 decides that data to be read out is present in the standard accompaniment pattern information SAS stored in the standard accompaniment pattern information memory circuit 96.

(1) Read Out and Storage of Pitch Data and ON/-OFF Data when the Count Contents of Tempo Clock Pulse Count Register 95 are "0" and "48":

When the count value of the tempo clock pulse count register 95 is "0", the data to be read out is the pitch data indicating the pitch "C2 (=0)" and the ON/OFF data indicating "ON", which are included in the tone generating data of the C2 note information AS-C2 of the standard accompaniment pattern information SAS, shown in FIG. 10, row 1. When the count value of the register 95 is "48", the data to be read out is the pitch data indicating the pitch "C2 (=0)" and the ON/OFF data indicating "OFF", which are included in the tone stopping data of the C2 note information AS-C2 shown in FIG. 10, row 1. Thus, when the count value of the tempo clock pulse count register 95 is "0", the pitch data indicating the pitch "C2 (=0)" and the ON/OFF data indicating "ON" are read out of the standard accompaniment pattern information memory circuit 96 and are stored in a pitch-ON/OFF data register 107, and then the routine proceeds to step 308. When the count value of the register 95 is "48", the pitch data indicating the pitch "C2 (=0)" and the ON/OFF data indicating "OFF" are read out of the memory circuit 96 and are stored in the pitch-ON/OFF data register 107, and then the routine proceeds to step 308.

(2) Read out and storage of Pitch Data and ON/OFF Data when the Count Contents of Tempo Clock Pulse Count Register 95 are "50" and "98":

When the count value of the tempo clock pulse count register 95 is "50", the pitch data indicating the pitch "D2 (=2)" and the ON/OFF data indicating "ON", which are included in the tone generating data of the D2 note information AS-D2 of the standard accompaniment pattern information SAS, shown in FIG. 10, row 2, are read out of the standard accompaniment pattern information memory circuit 96 and are stored in the pitch-ON/OFF data register 107, and then the routine proceeds to step 308. When the count value of the register 95 is "98", the pitch data indicating the pitch "D2 (=2)" and the ON/OFF data indicating "OFF", which are included in the tone stopping data of the D2 note information AS-D2 shown in FIG. 10, row 2, are read out of the memory circuit 96 and are stored in the pitch-ON/OFF data register 107, and then the routine proceeds to step 308.

(3) Read out and Storage of Pitch Data and ON/OFF Data when the Count Contents of Tempo Clock Pulse Count Register 95 are "100" and "148":

When the count value of the tempo clock pulse count register 95 is "100", the pitch data indicating the pitch "E2 (=4)" and the ON/OFF data indicating "ON", which are included in the tone generating data of the E2 note information AS-E2 of the standard accompaniment pattern information SAS, shown in FIG. 10, row 3, are read out of the standard accompaniment pattern information memory circuit 96 and are stored in the pitch-ON/OFF data register 107, and then the routine proceeds to step 308. When the count value of the register 95 is "148", the pitch data indicating the pitch "E2 (=4)" and the ON/OFF data indicating "OFF", which are included in the tone stopping data of the E2 note information AS-E2 shown in FIG. 10, row 3, are read out of the memory circuit 96 and are stored in the pitch-ON/OFF data register 107, and then the routine proceeds to step 308.

(4) Read out and Storage of Pitch Data and ON/OFF Data when the Count Contents of Tempo Clock Pulse Count Register 95 are "150" and "248":

When the count value of the tempo clock pulse count register 95 is "150", the pitch data indicating the pitch "C2 (=0)" and the ON/OFF data indicating "ON", which are included in the tone generating data of the C2 note information AS-C2′ of the standard accompaniment pattern information SAS, shown in FIG. 10, row 4, are read out of the standard accompaniment pattern information memory circuit 96 and are stored in the pitch-ON/OFF data register 107, and then the routine proceeds to step 308. When the count value of the register 95 is "248", the pitch data indicating the pitch "C2 (=0)" and the ON/OFF data indicating "OFF", which are included in the tone stopping data of the C2 note information AS-C2′ shown in FIG. 10, row 4, are read out of the memory circuit 96 and are stored in the pitch-ON/OFF data register 107, and then the routine proceeds to step 308.

(5) Read out of Storage of Pitch Data and ON/OFF Data when the Count Contents of Tempo Clock Pulse Count Register 95 are "250" and "298":

When the count value of the tempo clock pulse count register 95 is "250", the pitch data indicating the pitch "D2 (=2)" and the ON/OFF data indicating "ON", which are included in the tone generating data of the D2 note information AS-D2 of the standard accompaniment pattern information SAS, shown in FIG. 10, row 5, are read out of the standard accompaniment pattern information memory circuit 96 and are stored in the pitch-ON/OFF data register 107, and then the routine proceeds to step 308. When the count value of the register 95 is "298", the pitch data indicating the pitch "D2 (=2)" and the ON/OFF data indicating "OFF", which are included in the tone stopping data of the D2 note information AS-D2 shown in FIG. 10, row 5, are read out of the memory circuit 96 and are stored in the pitch-ON/OFF data register 107, and then the routine proceeds to step 308.

(6) Read out and Storage of Pitch Data and ON/OFF Data when the Count Contents of Tempo Clock Pulse Count Register 95 are "300" and "398":

When the count value of the tempo clock pulse count register 95 is "300", the pitch data indicating the pitch "E2 (=4)" and the ON/OFF data indicating "ON", which are included in the tone generating data of the E2 note information AS-E2′ of the standard accompaniment pattern information SAS, shown in FIG. 10, row 6, are read out of the standard accompaniment pattern information memory circuit 96 and are stored in the pitch-ON/OFF data register 107, and then the routine proceeds to step 308. When the count value of the register 95 is "398", the pitch data indicating the pitch "E2 (=4) and the ON/OFF data indicating "OFF", which are included in the tone stopping data of the E2 note information AS-E2' shown in FIG. 10, row 6, are read out of the memory circuit 96 and are stored in the pitch-ON/OFF data register 107, and then the routine proceeds to step 308.

STEP 308

Upon each storing of the pitch data and the ON/OFF data in the pitch-ON/OFF data register 107 in step 307, the pitch data is changed to pitch data indicating a pitch based on the description given on the selected pitch alteration table TB' stored in the selected pitch alteration table register 105 at that time. Then the routine proceeds to step 309.

Now this will be described in more detail.

(i) Where Selected Pitch Alteration Table TB' is Table TB-M shown in FIG. 2A, row 1:

In this instance, when the count contents of the tempo clock pulse count register 95 are "0" and "48", "50" and "98", "100" and "148", "150" and "248", "250" and "298", and "300" and "398" in step 307, the pieces of pitch data indicating the pitches "C2" and "C2", "D2" and "D2", "E2" and "E2", "C2" and "C2", "D2" and "D2", and "E2" and "E2" in FIG. 10, rows 1, 2, 3, 4, 5 and 6, which are stored in the pitch-ON/OFF data register 107, are held unchanged as shown in FIG. 11, rows 1, 2, 3, 4, 5 and 6. Then the routine proceeds to step 309.

(ii) Where Selected Pitch Alteration Table TB' is Table TB-M shown in FIG. 2A, row 3:

In this instance, when the count contents of the tempo clock pulse count register 95 are "50" and "98", and "250" and "298" in step 307, the pieces of pitch data indicating the pitch "D2(=2)" in FIG. 10, rows 2 and 5, which are stored in the pitch-ON/OFF data register 107, are not altered to pitch data of a different pitch, as shown in FIG. 12, rows 2 and 5. When the count values of the tempo clock pulse count register 95 are "0" and "48", "100" and "148", "150" and "248", and "300" and "398", however, the pieces of pitch data indicating the pitches "C2" and "C2", "E2" and "E2", "C2" and "C2", and "E2" and "E2" in FIG. 10, rows 1, 3, 4 and 6, which are stored in the pitch-ON/OFF data register 107, are altered to pitch data indicating the pitch "D2(=2)" as shown in FIG. 12, rows 1, 3, 4 and 6. Then the routine proceeds to step 309.

(iii) Where Selected Pitch Alteration Table TB' is Table TB-m shown in FIG. 3A, row 1:

In this instance, when the count contents of the tempo clock pulse count register 95 are "0" and "48", "50" and "98", "150" and "248", and "250" and "298" in step 307, the pieces of pitch data indicating the pitches in FIG. 10, rows 1, 2, 4 and 5, which are stored in the pitch-ON/OFF data register 107, are not altered to pitch data of a different pitch, as shown in FIG. 13, rows 1, 2, 4 and 5. When the count values of the tempo clock pulse count register 95 are "100" and "148", and "300" and "398", however, the pieces of pitch data indicating the pitches shown in FIG. 10, rows 3 and 6, which are stored in the pitch-ON/OFF data register 107, are altered to pitch data indicating the pitches "E2♭" and "E2", and "E2♭" and "E2♭" as shown in FIG. 13, rows 3 and 6. Then the routine proceeds to step 309.

(iv) Where Selected Pitch Alteration Table TB' is Table TB-M shown in FIG. 3A, row 4:

In this instance, when the count contents of the tempo clock pulse count register 95 are "50" and "98", and "250" and "298" in step 307, the pieces of pitch data indicating the pitch "D2(=2)" in FIG. 10, rows 2 and 5, which are stored in the pitch-ON/OFF data register 107, are not altered to pitch data of a different pitch, as shown in FIG. 14, rows 2 and 5. When the count values of the tempo clock pulse count register 95 are "0" and "48", "100" and "148", "150" and "248", and "300" and "398", however, the pieces of pitch data indicating the pitches shown in FIG. 10, rows 1, 3, 4 and 6 which are stored in the pitch-ON/OFF data register 107, are altered to pitch data indicating the pitches "E2♭" and "E2♭", "G2" and "G2", "E2♭" and "E2♭", and "G2" and "G2" as shown in FIG. 14, colums 1, 3, 4 and 6. Then the routine proceeds to step 309.

(v) Where Selected Pitch Alteration Table TB' is Table TB-m shown in FIG. 3B, row 8:

In this instance, when the count contents of the tempo clock pulse count register 95 are "50" and "98", and "250" and "298" in step 307, the pieces of pitch data indicating the pitch "D2(=2)" in FIG. 10, rows 2 and 5, which are stored in the pitch-ON/OFF data register 107, are not altered to pitch data of a different pitch, as shown in FIG. 15, rows 2 and 5. When the count values of the tempo clock pulse count register 95 are "0" and "48", "100" and "148", "150" and "248", and "300" and "398", however, the pieces of pitch data indicating the pitches shown in FIG. 10, rows 1, 3, 4 and 6 which are stored in the pitch-ON/OFF data register 107, are altered to pitch data indicating the pitches "G2" and "G2", "C3" and "C3", "G2" and "G2", and "C3" and "C3" as shown in FIG. 15, rows 1, 3, 4 and 6. Then the routine proceeds to step 309.

(vi) Where Selected Pitch Alteration Table TB' is Table TB-dim shown in FIG. 4A, row 1:

In this instance, when the count contents of the tempo clock pulse count register 95 are "0" and "48", "50" and "98", "150" and "248", and "250" and "298" in step 307, the pieces of pitch data indicating the pitches in FIG. 10, rows 1, 2, 4 and 5, which are stored in the pitch-ON/OFF data register 107, are not altered to pitch data of a different pitch, as shown in FIG. 16, rows 1, 2, 4 and 5. When the count values of the tempo clock pulse count register 95 are "100" and "148", and "300" and "398", however, the pieces of pitch data indicating the pitches shown in FIG. 10, rows 3 and 6, which are stored in the pitch-ON/OFF data register 107, are altered to pitch data indicating the pitches "E2♭" as shown in FIG. 16, rows 3 and 6. Then the routine proceeds to step 309.

(vii) Where Selected Pitch Alteration Table TB' is Table TB-m7 shown in FIG. 5A, row 1.

In this instance, when the count contents of the tempo clock pulse count register 95 are "0" and "48", "50" and "98", "150" and "248", and "250" and "298" in step 307, the pieces of pitch data indicating the pitches in FIG. 10, rows 1, 2, 4 and 5, which are stored in the pitch-ON/OFF data register 107, are not altered to pitch data of a different pitch, as shown in FIG. 17, rows 1, 2, 4 and 5. When the count values of the tempo clock pulse count register 95 are "100" and "148", and "300" and "398", however, the pieces of pitch data indicating the pitches shown in FIG. 10, rows 3 and 6, which are stored in the pitch-ON/OFF data register 107, are altered to pitch data indicating the pitch "E2♭" as shown in FIG. 17, rows 3 and 6. Then the routine proceeds to step 309.

STEP 309

Upon each storing of the pitch data and the ON/OFF data in the pitch-ON/OFF data register 107 in step 307, the pitch data is altered to pitch data indicating a pitch shifter by the shift amount represented by the shift amount information ES stored in the shift amount information register 106 at that time. Then the routine proceeds to step 310.

Now, this will be described in more detail.

(i) In the case where the pitch name of the chord root represented by the chord root information RS stored in the chord root information register 103 is "C" as shown in FIGS. 2A through 5B, the pitch difference between the pitch name of the chord root and the pitch name of the note "C", which is the shift amount indicated by the shift amount information ES, is "0" in decimal as shown in FIGS. 2A through 5B.

(ii) In the case where the pitch names of the chord root represented by the chord root information RS stored in the chord root information register 103 is "C# (=D♭)" or "D# (=E♭)" or . . . , the above-mentioned pitch difference is "1" or "2" or "3" or . . . in decimal.

This is done by the following processing. Let it be assumed that the contents of the chord root information RS stored in the chord root information register 103 remain unchanged while the count value of the tempo clock pulse count register 95 varies from "0" to "400".

(i) Where Pitch Name of Root Note Indicated by Chord Root Information RS is "C"

In this instance, when the count contents of the tempo clock pulse count register 95 are "0" and "48", "50" and "98", "100" and "148", "150" and "248", "250" and "298", and "300" and "398", the pieces of pitch data stored in the pitch-ON/OFF data register 107 in step 308 are each altered to pitch data of pitch shifted by "0" in decimal (that is, the pitch being not shifter), regardless of whether the chord type of major (M), minor (m), diminisehd (dim) or minor seventh (m7). Then the route proceeds to step 310.

(ii) Where Pitch Name of Root Note is "C# (=D♭)", "D", "D# (=E♭)", . . . :

In this instance, when the count contents of the tempo clock pulse count register 95 are "0" and "48", "50" and "98", "100" and "148", "150" and "248", "250" and "298", and "300" and "398", the pieces of pitch data stored in the pitch-ON/OFF data register 107 in step 108 are all altered to pieces of pitch data of pitches shifted by "1", "2", "3", . . . . in decimal, regardless of whether the chord type is major (M), minor (m), diminished (dim) or minor seventh (m7).

STEP 310

The pitch data and the ON/OFF data stored in the pitch-ON/OFF data register 107 are provided to a tone source circuit 98. When the ON/OFF data is "ON", that is, when the pitch data and the ON/OFF data constitute the tone generating data, the tone source circuit 98 is controlled to generate a tone of the pitch represented by the pitch data. On the other hand, when the ON/OFF data is "OFF", that is when the pitch data and the ON/OFF data constitute the tone stopping data, the tone source circuit 98 is controlled not to generate the tone of the pitch indicated by the pitch data. Then the route proceeds to step 311.

Now, this will be described in more detail.

(i) Where Pitch Name of Chord Root is "C":

In this instance, when the count contents of the tempo clock pulse count register 95 are "0" and "48", "50" and "98", "100" and "148", "150" and "248", "250" and "298", and "300" and "398", the tone generating data and the tone stopping data formed by the pitch data and the ON/OFF data stored in the pitch-ON/OFF data register 107 ar provided to the tone source circuit 98, regardless of whether chord type indicated by the chord type information CS stored in the chord type information register 102 is major (M), minor (m), diminished (dim), or minor seventh (m7). Then the route proceeds to step 311. Thus, while the count value of the tempo clock pulse count register 95 varies from "0" to "400", the tone source circuit 98 generates accompaniment notes of the accompaniment pattern shown in FIG. 2A, rows 1, 3, or 5, or FIG. 2B, row 8; FIG. 3A, rows 1, 3, or 4, or FIG. 3B, row 8; FIG. 4A, rows 1 or 4, or FIG. 4B rows 7 or 10 or FIG. 5A, rows 1, 3, or 4, or FIG. 5B, rows 8 or 11.

(ii) Where Pitch Name of Chord Root is "C# (=D♭)", "D", "D# (=E♭)", . . . :

In this instance, when the count contents of the tempo clock pulse register 95 are "0" and "48", "50" and "98", "100" and "148", "150" and "248", "250" and "298", and "300" and "398", tone generating data and tone stopping data formed by pitch data and ON/OFF data indicating pitches shifted by "1", "2", "3", . . . in decimal from the pitches represented by the pitch data stored in the pitch-ON/OFF data register 107 are provided to the tone source circuit 98, regardless of whether chord type indicated by the chord type information CS stored in the chord type information register 102 is major (M), minor (m), diminished (dim), or minor seventh (m7). Then the route proceeds to step 311. Thus while the count value of the tempo clock pulse count register 95 varies from "0" to "400", the tone source circuit 98 generates accompaniment notes of the accompaniment pattern shifter in pitch by "1", "2", "3", . . . in decimal from the accompaniment pattern shown in FIG. 2A, rows 1, 3, or 5, or FIG. 2B, row 8; FIG. 3A, rows 1, 3 or 4, or FIG. 3B row 8; FIG. 4A, rows 1 or FIG. 4B, rows 7 or 10; or FIG. 5A, rows 1, 3, or 4, or FIG. 5B, rows 8.

STEP 311

In this step, the execution of the tempo interruption processing ends and the process returns to the point in the main routine where the tempo interruption was caused.

It will be appreciated from the above that the operational results described previously with respect to FIG. 1 can be obtained with the automatic accompaniment device of the present invention.

Figure 18:
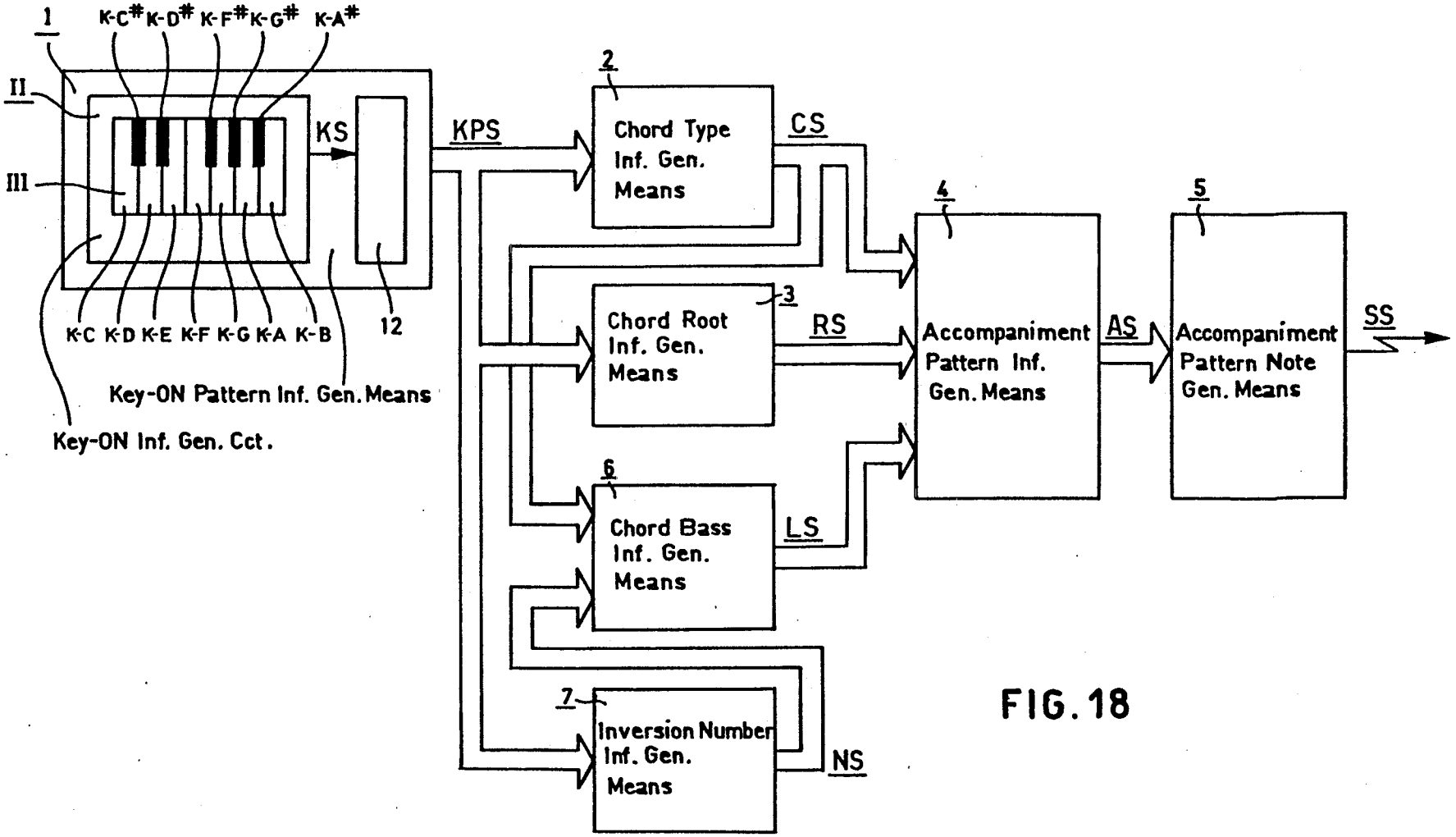
FIG. 18 is a second solution of the invention.

FIG. 18 relates to a second embodiment of the invention in which the chord bass information generating means 6 is fed by information received by chord type information generating means 2 and an inversion number information generating means 7 which at the same time receives Key-ON pattern information from key-ON pattern information generating means 7.

What is claimed is:

1. An automatic accompaniment device for an electronic musical instrument, comprising:

chord type information generating means having an output, said means for generating chord type information indicating one of the types of chords being produced;

chord root information generating means having an output, said means for generating chord root information indicating the pitch name of a root note of said one chord type;

chord bass information generating means having an output, said means for generating chord bass information indicating the pitch name of the lowest note of said chord type; and accompaniment pattern information generating means connected to the outputs of said chord type information generating means, said chord root information generating means and said chord bass information generating means for generating accompaniment pattern information of the contents corresponding to said chord type information, said chord root information and said chord bass information;

wherein said accompaniment pattern information includes chord tone information indicating, for each tone of the said pattern information, a chord tone of the pitch name of a note constituting said chord, and non-chord-tone information indicating a non-chord-tone of the pitch name of a note other than said note constituting said chord; and accompaniment pattern note generating means operationally coupled to said information accompaniment pattern means and receiving the information from said accompaniment pattern information generating means, for changing the pitch name of each chord tone, in said chord tone information, with a pitch name of the tones of the chord and in relation to the pitch name of the lowest note of said chord, while maintaining unchanged said non-chord-tone information.

2. The automatic accompaniment device of claim 1, having key-On pattern information generating means wherein said chord type information generating means, said chord root information generating means and said chord bass information generating means generate said chord type information, said chord root information and said chord bass information, respectively, based on information provided by said key-ON pattern information generating means.

3. The automatic accompaniment device of claim 1, wherein said chord type information generating means, said chord root information generating means and said chord bass information generating means generate said chord type information and said chord root information based on information provided by a key-On pattern information generating means, and in which said chord bass information is based on information received by said chord bass information generating means, from said chord type information generating means and from an inversion number information generating means which at the same time received information by said key-ON pattern information generating means.

* * * * *